US009892692B2

(12) United States Patent
Nageli et al.

(10) Patent No.: US 9,892,692 B2
(45) Date of Patent: Feb. 13, 2018

(54) MEDIA SYSTEM CONTROLLERS

(71) Applicant: Harman International Industries, Inc., Stamford, CT (US)

(72) Inventors: Shawn Nageli, South Jordan, MI (US); Iain Gregory, Plymouth, MI (US)

(73) Assignee: Harman International Industries, Incorporated, Stamford, CT (US)

( * ) Notice: Subject to any disclaimer, the term of this patent is extended or adjusted under 35 U.S.C. 154(b) by 231 days.

(21) Appl. No.: 14/737,921

(22) Filed: Jun. 12, 2015

(65) Prior Publication Data

US 2015/0364097 A1 Dec. 17, 2015

Related U.S. Application Data

(60) Provisional application No. 62/012,230, filed on Jun. 13, 2014.

(51) Int. Cl.
*G09G 3/34* (2006.01)

(52) U.S. Cl.
CPC ..... *G09G 3/3413* (2013.01)

(58) Field of Classification Search
CPC ..... G09G 3/3413
See application file for complete search history.

(56) References Cited

U.S. PATENT DOCUMENTS

| | | | | |
|---|---|---|---|---|
| 9,141,257 | B1 * | 9/2015 | Goldstein | G06F 3/167 |
| 2007/0016314 | A1 | 1/2007 | Chan et al. | |
| 2008/0025535 | A1 * | 1/2008 | Rajapakse | H04L 65/605 381/311 |
| 2011/0205258 | A1 * | 8/2011 | Suminoe | G09G 3/3406 345/690 |

FOREIGN PATENT DOCUMENTS

GB 2525885 A 11/2015

OTHER PUBLICATIONS

Combined Search and Examination Report dated Dec. 9, 2015 in App. No. GB1510209.8.

* cited by examiner

*Primary Examiner* — Carolyn R Edwards
*Assistant Examiner* — Scott Au
(74) *Attorney, Agent, or Firm* — Brooks Kushman P.C.

(57) ABSTRACT

A controller may include a programmable user interface controls configured to receive user input. The controller may also include multi-color backlights configured to backlight the programmable user interface controls. The controller may receive configuration information specifying an assignment of controllable parameters of the media system and associated backlighting colors to the at least one programmable user interface control, and may direct the multi-color backlights to backlight the programmable user interface controls in colors accordance with backlighting color information specified by the configuration information. The controller may further control a display screen to display the graphics or text descriptive of the assignable buttons in accordance with control descriptions included in the configuration information.

17 Claims, 30 Drawing Sheets

MEDIA SYSTEM CONTROLLERS

CROSS-REFERENCE TO RELATED APPLICATIONS

This application claims the benefit of U.S. provisional application Ser. No. 62/012,230 filed Jun. 13, 2014, the disclosure of which is hereby incorporated in its entirety by reference herein.

TECHNICAL FIELD

Aspects disclosed herein generally relate to media system controllers, such as wall controllers, that may be utilized to configure and display information for media systems.

BACKGROUND

A media system may be installed to a venue. The media system may receive media content from multiple sources, and may provide the media content to multiple zones of the venue. To facilitate configuration of which content is to be provided to what zones, the media system may include one or more control panels or controllers. These controllers may allow a user to adjust the source, volume, or other aspects of the provided media content. In some cases, the controllers may be mounted to walls of the venue, such as within standard-sized electrical boxes.

When the media system is initially set up or later updated, an installer may manually wire and label the various controls of the media system to explain the functions of the controls to a user. This labeling may include, for example, stick-on type labeling or other mechanical labeling to name or otherwise identify functionality of the controls. Due to the devices in the system being distributed throughout the venue, the installer may have difficulty locating and reconfiguring the particular devices to accomplish a particular task. Moreover, due to inconsistent labeling, the user may experience difficulty with understanding the available functions of the system.

SUMMARY

In a first illustrative embodiment, a controller apparatus of a media system includes a processor connected to the media system via a network connection; at least one programmable user interface control configured to receive user input; at least one multi-color backlight configured to backlight a respective one of the at least one programmable user interface controls in a specified color; and configuration information specifying an assignment of controllable parameters of the media system and associated backlighting colors to the at least one programmable user interface control; wherein the processor is configured to direct the multi-color backlight to backlight the at least one programmable user interface control in accordance with the backlighting color information.

In a second illustrative embodiment, a controller apparatus for a media system includes a user interface a display screen; assignable buttons each configured to be backlit in a controllable color and intensity and associated with respective screen position of the display screen configured to display information descriptive of the respective assignable button; a display backlight configured to backlight each of the respective screen positions in a controllable color and intensity; an encoder; and an encoder light control configured to backlight the encoder in a controllable color and intensity; and a processor configured to receive configuration information specifying an assignment of controllable parameters of the media system, control descriptions, and associated backlighting colors to the at least one programmable user interface control; control the display screen to display the information descriptive of the assignable buttons in accordance with the control descriptions; and control the backlighting of the assignable buttons, display backlight, and encoder light control in accordance with the associated backlighting colors.

In a third illustrative embodiment, a method for controlling a media system includes receiving, over a network by a media system controller, configuration information specifying an assignment of controllable parameters of the media system to programmable user interface controls of the media system controller; displaying information descriptive of the controllable parameters specified by the configuration information in a display screen of the media system controller; and backlighting the programmable user interface controls according to color information specified by configuration information.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 1:
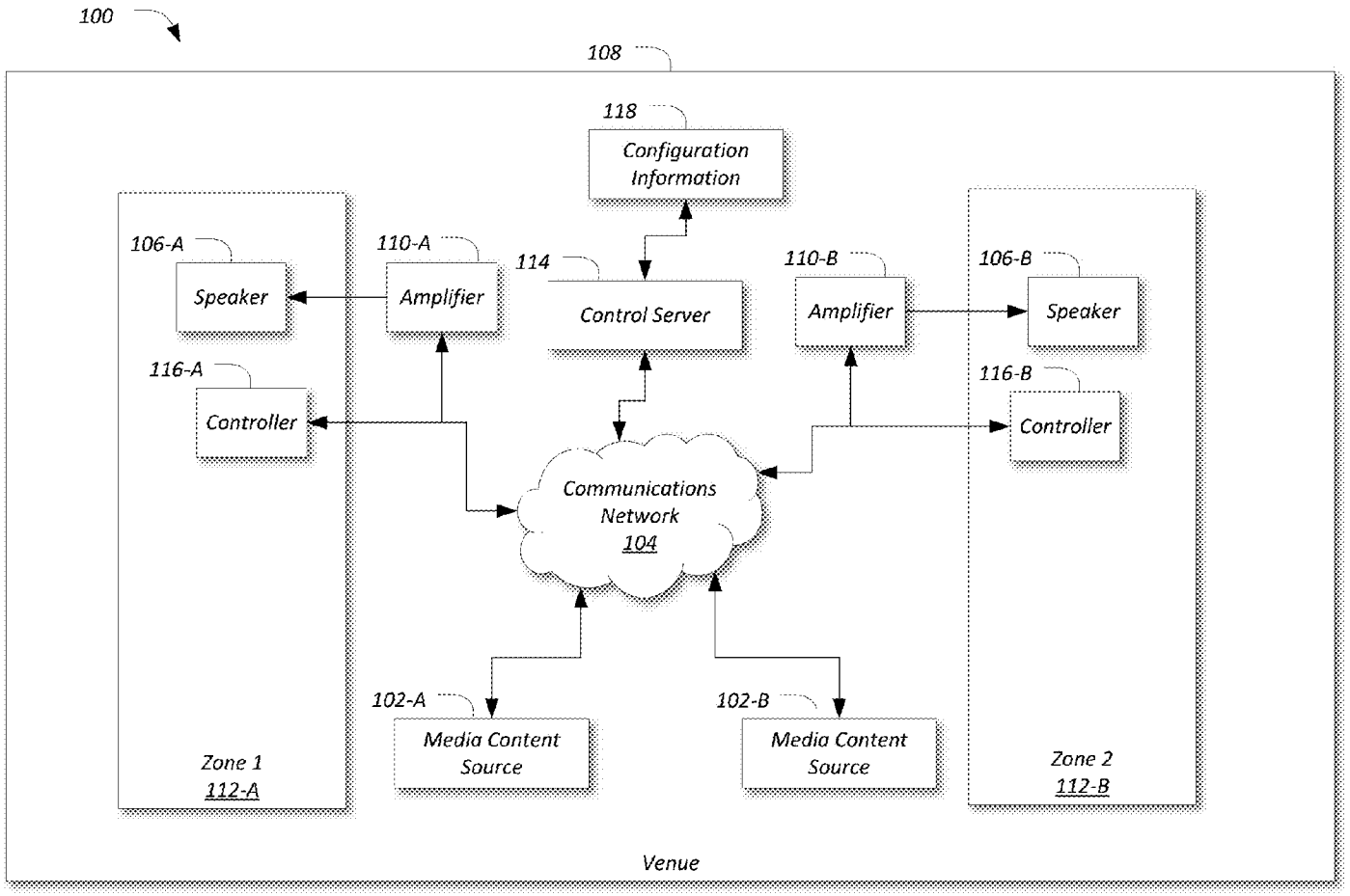
FIG. 1 is a block diagram of an example of a media system of a venue having a plurality of controllers and other media devices, in accordance to one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Controllers of a media system may receive input from a user to adjust parameters of amplifiers or other devices of the media system. The controller may also illustrate one or more parameters related to the operation of the media system. To perform these functions, a user interface of the controller may include one or more assignable buttons, encoders, sliders, switches, meters and display screens. The user interface may be backlit in various colors and with adjustable intensity to assist users in the visual identification of information displayed by the controller. The controllers may further include a network port configured to support remote configuration, device control, parameter monitoring, and powering of the controller. In an example, the controller may be configured from a user interface of a control server of the network using the HiQnet Audio Architect software package distributed by Harman International.

The controllers may be available in several hardware configurations. As some non-limiting examples, these configurations may include: an encoder controller having a rotary or other encoder, a four-button controller having four assignable buttons but no encoder, a four-button-and-encoder controller having both the encoder and the four assignable buttons, and an eight-button-and-encoder controller having the encoder and also eight assignable buttons. It should be noted that these are merely examples, and other controller configurations are possible.

The encoder control may be a rotary encoder configured to receive rotational input from a user for continuous parameter control (e.g. volume). The rotary encoder may further include button functionality such that the encoder may be pressed for binary parameter control (e.g. mute) or preset recall. The encoder ring may also be associated with a meter. For instance, the rotary encoder may be surrounded by an encoder ring (e.g., a seven-segment encoder ring) configured to display a bouncing audio meter for the currently selected zone or source. When the push/rotary encoder is rotated, the encoder ring may temporarily display a current value of a continuous parameter associated with the encoder (e.g., a current volume setting being adjusted). When the push/rotary encoder is pressed, the encoder ring may temporarily display a binary parameter associated with the encoder being adjusted (e.g. red for muted status, green for an unmuted status, etc.). When the user input to the encoder is concluded, the encoder ring may revert back to the bouncing audio meter. The assignable buttons may also be pressed for binary parameter control (e.g., mute), preset recall, zone selection, or source selection.

The buttons, display screens, and meters may support configurable backlighting in various colors and intensities to assist users in the visual identification of information displayed by the controller. In an example, each of the assignable buttons may be backlit in an assignable color, and may be associated with a display screen or a position of a display screen also backlit in the color of the button. The display screen or screen position may further provide label information indicative of the function of the associated button. In many examples, a dimly-illuminated assignable button may indicate an available zone, source, preset or parameter, while a brightly-illuminated assignable button may indicate a currently-selected zone, source, preset or parameter. Additionally or alternately, sources, presets and parameters may be represented by the assignable buttons in backlight colors appropriate for the given zone.

In some examples, the specific parameters to be adjusted by the encoder may depend on which one of the assignable buttons is currently selected. For example, each assignable button may be associated with a zone, such that when one of the assignable buttons is selected by the user, the controller may set the encoder to receive input for the selected zone. This allows the push/rotary encoder and encoder ring to be reassigned dynamically to different parameters based on which buttons are selected. Moreover, to allow the user to readily identify which parameters of the media system are selected to be controlled by the encoder, the controller may backlight the encoder light control of the encoder in the color associated with the selected assignable button. For instance, each assignable button may be backlit in a different color associated with its zone, and the encoder may be backlit in the color of the selected assignable button. Thus, backlighting of the encoder may be used to allow the user to visually identify which aspects may be controlled or monitored by the encoder control.

In some examples, the controller may also support "sleep" functionality. After a specified amount of time with no user input, the controller may turn off the backlighting. This may be useful to avoid distraction in a dimly-lit environment. Any user interaction with the controller may "wake up" the controller and re-engage the backlighting. The controller may also support being remotely locked and unlocked via by other controls of the media system via the communications network. For those controllers including assignable buttons, the controller may be locally unlocked via entry of a code using the assignable buttons. Further aspects of the controllers are discussed in detail below.

FIG. 1 is a block diagram of an example of a media system 100 of a venue 108 having a plurality of controllers 116 and other media devices. As illustrated, the media system 100 includes a plurality of media content sources 102. The media content sources 102 may provide media content over a communications network 104 to amplifiers 110 driving speakers 106 of various zones 112 of the venue 108. The controllers 116 may receive user input to control the media content sources 102 and amplifiers 110 of the media system 100. The media system may further include a control server 114 maintaining configuration information 118 descriptive of the parameters controllable by the controllers 116, and may provide the configuration information 118 to the controllers 116 via the communications network 104. The media system 100 may be permanently installed to the venue 108 such as to a conference center, vehicle, or amusement park, although the same principles and techniques disclosed herein may be applied to temporary installed sound system, such as for a rock concert in a stadium. It should be noted that the illustrated system 100 is merely an example, and more, fewer, and/or differently located elements may be used.

The media content sources 102 may be any form of one or more devices capable of generating and outputting different media signals, such as one or more channels of audio and one or more feeds of video. Examples of media content sources 102 may include a media player, such as a compact disc, video disc, digital versatile disk (DVD), or BLU-RAY disc player, a video system, a radio, a cassette tape player, a wireless or wireline communication device, a navigation system, a personal computer, a player device such as an MP3 player or an IPOD™, an audio capture device such as a microphone, an instrument such as a keyboard or electric guitar, or any other form of media device capable of outputting media signals. As shown, the media system 100 includes two media content sources 102 (e.g., 102-A and 102-B). In other examples, the media system 100 may include more, fewer, and/or differently located media content sources 102.

The communications network 104 may be any form of communication system capable of carrying media signals and/or control signals related to the elements of the media system 100. The communications network 104 may include fiber optic, wired, and/or wireless communication capability in any of a plurality of protocols, such as Ethernet, USB, RS232, RS485, Firewire, or any other protocol, including AV bridging (AVB) Ethernet. In some examples, the communications network 104 may be further configured to provide power to at least some of the devices connected to the network, e.g., via power-over-Ethernet (PoE) in an example.

The speakers 106 may be any of various types of devices configured to convert electrical signals into audible sound waves. As some possibilities, the speakers 106 may include dynamic loudspeakers having a coil operating within a magnetic field and connected to a diaphragm, such that application of the electrical signals to the coil causes the coil to move through induction and power the diaphragm. As some other possibilities, the speakers 106 may include other types of drivers, such as piezoelectric, electrostatic, ribbon or planar elements.

The venue 108 may include various types of locations having speakers 106 configured to provide audible sound waves to listeners. In an example, the venue 108 may be a room or other enclosed area such as a concert hall, stadium, restaurant, auditorium, or vehicle cabin. In another example, the venue 108 may be an outdoor or at least partially-unenclosed area or structure, such as an amphitheater or stage. As shown, the venue 108 included two speakers 106 (e.g., 106-A and 106-B). In other examples, the venue 108 may include more, fewer, and/or differently located speakers 106.

The amplifiers 110 may be any circuit or standalone device that receives audio input signals of relatively small magnitude, and outputs similar audio signals of relatively larger magnitude. Audio input signals may be received by the amplifier 110 via the communications network 104 and output to the loudspeakers 106. In addition to amplification of the amplitude of the audio signals, the amplifier 110 may also include signal processing capability to shift phase, adjust frequency equalization, adjust delay or perform any other form of manipulation or adjustment of the audio signals. The amplifiers 110 may additionally include capability to adjust volume, balance and/or fade of the audio signals provided to the loudspeakers 106. An example amplifier 110 may be a Crown DCi-series amplifier distributed by Harman International. In an alternative example, one or more loudspeakers 106 may include amplifiers 110 that are integrated into the loudspeaker 106 devices (e.g., self-powered loudspeakers 106).

The zones 112 may refer to various subsets of the locations within the venue 108 for which specific media settings are utilized. In some cases, the venue 108 may be relatively small or homogenous, or may include one or very few speakers 106. In such cases, the venue 108 may include only a single zone 112. In other cases, the venue 108 may include multiple different zones 112 each having its own associated media settings. As shown, the venue 108 included two zones 112 (e.g., 112-A and 112-B). In other examples, the venue 108 may include more, fewer, and/or differently located zones 112.

The control server 114 may be any of various devices configured to maintain configuration information 118 descriptive of the particular settings controllable by the controllers 116 of the media system 100. Likewise, the controllers 116 may be any of various devices configured to receive the configuration information 118 and present a user interface in accordance with the configuration information 118. The configuration information 118 may include, as some examples, indications of which media content sources 102 are available for selection by which controllers 116, or which settings of the various zones 112 are available for adjustment by the controllers 116. As some examples, the controller 116 may allow users to select which media content source 102 should provide media content to the speakers 106 of a zone 112, or to adjust an amount of amplification provided by the amplifiers 110 to the speakers 106 of the zone 112.

Figure 2A:
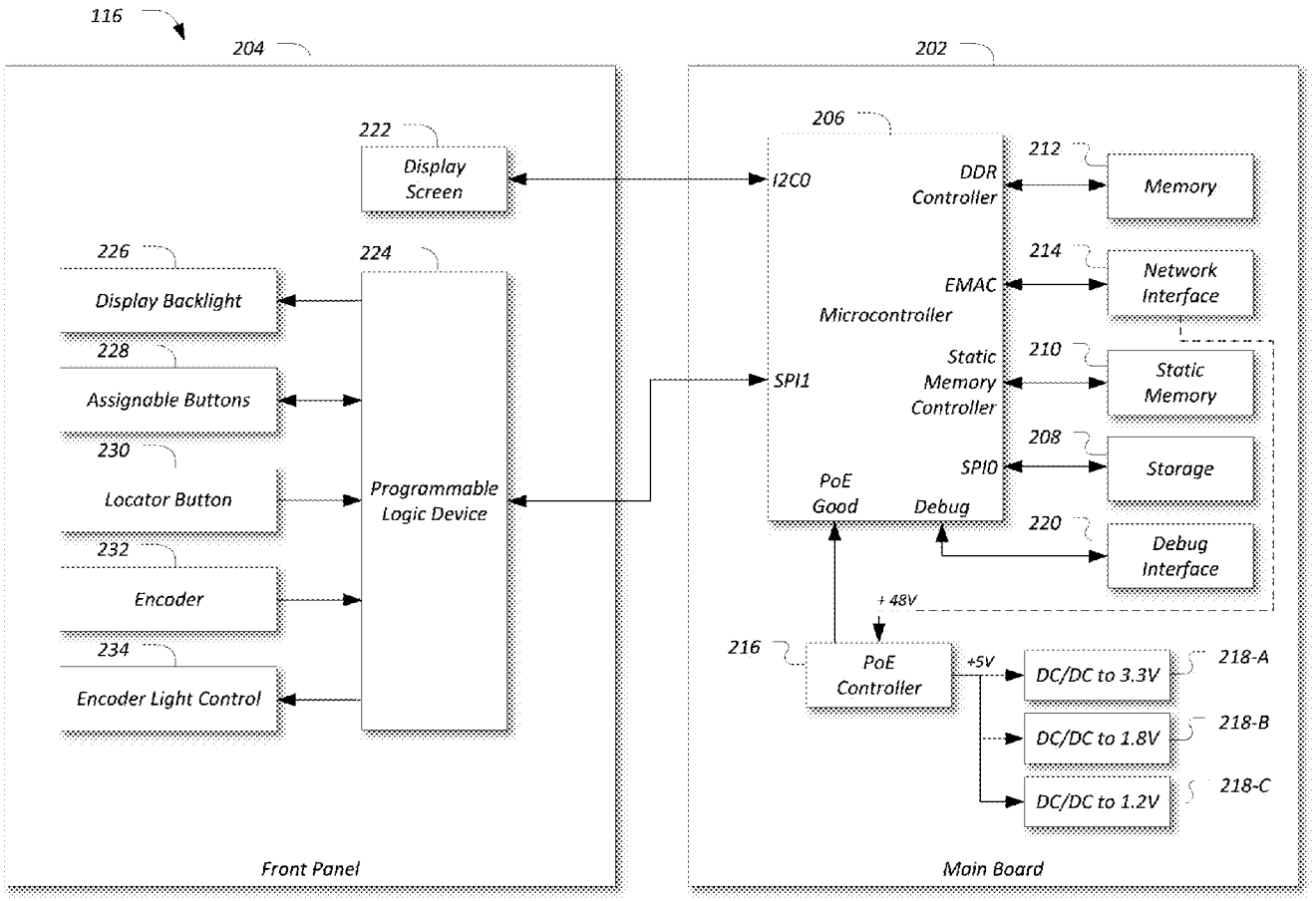
FIG. 2A illustrates an example block diagram of a controller, in accordance to one embodiment.

FIG. 2A illustrates an example block diagram 200 of a controller 116. The controller 116 may include a main board 202 including processing elements of the controller 116, and a front-panel board 204 connected to the main board 202 and including user interface and control elements of the controller 116. As the main board 202 and front-panel board 204 may be different elements, the same main board 202 may be able to be used with different front-panel board 204 hardware configurations.

The main board 202 may include one or more microcontrollers 206 configured to perform instructions, commands and other routines in support of the processes of the controller 116 described herein. Such instructions and other data may be maintained in a non-volatile manner using a variety of types of computer-readable storage media. The computer-readable medium (also referred to as a processor-readable medium or storage) includes any non-transitory medium (e.g., a tangible medium) that participates in providing instructions or other data that may be read by the microcontrollers 206 of the main board 202. For example, the microcontrollers 206 may load instructions stored to a flash, electrically erasable programmable read-only memory (EEPROM) other persistent storage 208 medium connected to an interface of the microcontrollers 206 (e.g., to a serial peripheral interface (SPI)) or stored to a static memory 210 connected to a static memory controller of the microcontrollers 206, and may store the instructions or other data into a random-access memory 212 (e.g., a double data rate synchronous dynamic random-access memory (DDR SDRAM) connected to a DDR controller of the microcontroller 206). Computer-executable instructions may be compiled or interpreted from computer programs created using a variety of programming languages and/or technologies, including, without limitation, and either alone or in combination, Java, C, C++, C#, Objective C, Fortran, Pascal, Java Script, Python, Perl, and PL/SQL.

The main board 202 may further include a network interface 214 configured to facilitate communication of the controller 116 over the communications network 104. In an example, the controller may utilize the HiQnet communications protocol over the communications network 104 to communicate with the other devices of the media system 100. In an example, the network interface 214 may include an Ethernet connection to an Ethernet media access controller (EMAC) of the controller 116.

In some cases, the controller 116 may additionally be powered via the communications network 104, such as using power over Ethernet (PoE). Such a powered system may allow the controller 116 to be wired in via the network interface 214, without requiring an additional power connection. For instance, the main board 202 may include a PoE controller 216 configured to receive power from the network interface 214 and provide the received power to one or more voltage regulators 218 to convert the received powered into sources from which the controller 116 may be powered. As one non-limiting possibility, the voltage regulators 218 may include a direct current (DC) to DC converter voltage regulator 218-A receiving power from the PoE controller 216 and outputting 3.3V DC, a DC/DC voltage regulator 218-B receiving the power from the PoE controller 216 and outputting 1.8V DC, and a DC/DC voltage regulator 218-C receiving the power from the PoE controller 216 and outputting 1.2V DC. The PoE controller 216 may further provide a PoE good signal to the microcontroller 206, to inform the microcontroller 206 when the voltage regulators 218 are providing suitable power for the controller 116 to use.

The main board 202 may further expose a debug interface 220 of the microcontroller 206 in order to allow for attachment of a debugger device external to the controller 116 for debugging of code executed by the microcontroller 206.

The front-panel board 204 may be connected to the microcontroller 206 of the main board 202, and may provide the user interface controls and displays for interaction with users of the media system 100. For example, the front-panel board 204 may include a display screen 222 connected to an inter-integrated circuit (I2C) connection to the microcontroller 206, and a programmable logic device 224 connected to a SPI connection to the microcontroller 206.

The programmable logic device 224 may be configured to facilitate input and output control between the microcontroller 206 and the various controls of the front-panel board 204. In an example, the display screen 222 may be an LCD screen that is backlit by a display backlight 226 into multiple separately-configurable screen positions 252, and the programmable logic device 224 may be connected to the display backlight 226 to facilitate brightness and color control of the display backlight 226 by the microcontroller 206. In another example, the programmable logic device 224 may be connected to one or more assignable buttons 228, and may provide indications of user input entered to the assignable buttons 228 to the microcontroller 206. The assignable buttons 228 may include backlight functionality as well, and the programmable logic device 224 may be configured to interpret instructions from the microcontroller 206 to allow for the adjustment of the brightness and/or backlight color of the assignable buttons 228, display backlight 226, and encoder light control 234.

The programmable logic device 224 may also be connected to a locator button 230, and may be configured to indicate to the microcontroller 206 when the locator button 230 is selected by the user. Responsive to receiving input indicative of user selection of the locator button 230, the microcontroller 206 may broadcast a locate signal over the communications network 104 that may be received by the control server 114 to allow the control server 114 to identify the identify the network identity of the controller 116 being located.

The programmable logic device 224 may also be connected to an encoder 232, and may be configured to indicate to the microcontroller 206 a value, location, or amount of motion or change specified by a user using the encoder 232. As one possibility, the encoder 232 may be a rotary encoder, while in other examples the encoder 232 may be a linear encoder (e.g., a slider) or another type of control capable of specifying motion or positional information.

The programmable logic device 224 may also be connected to an encoder light control 234, and may be configured to allow the microcontroller 206 to specify brightness, color, and/or a value to be expressed by the encoder light control 234. In an example, the encoder 232 may be a rotary encoder, and the encoder light control 234 may be a light ring surrounding the encoder 232. The light ring may include, e.g., seven segments, arranged in a ring surrounding a shaft of the encoder 232, although more or fewer segments may be used. In another example, the encoder 232 may be a linear encoder, and the encoder light control 234 may be a linear bar control.

Figure 2B:
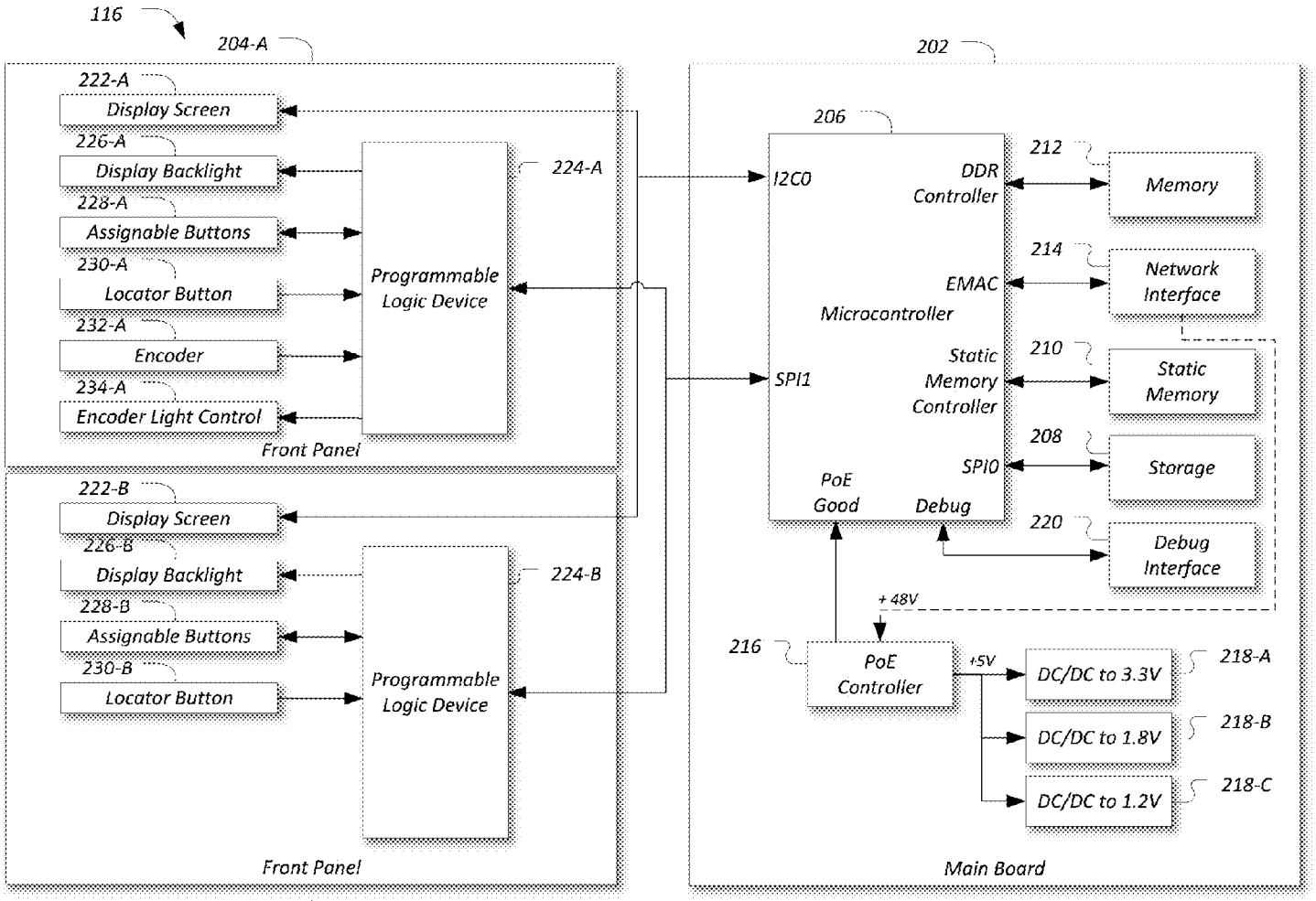
FIG. 2B illustrates an alternate example block diagram of a controller, in accordance to one embodiment.

As illustrated in FIG. 2A, the front-panel board 204 includes a display screen 222, a display backlight 226, assignable buttons 228, a locator button 230, an encoder 232, and an encoder light control 234. It should be noted that this is only an example controller 116, and other controllers 116 may include more, fewer, or different controls. As another example, FIG. 2B illustrates an example controller 116 having two front-panel boards 204: a front-panel board 204-A having assignable buttons 228-A and an encoder 232-A, and a front-panel board 204-B having additional assignable buttons 228-B. FIGS. 3A-3D each illustrates different example configurations of controllers 116 having different sets of controls.

Figure 2C:
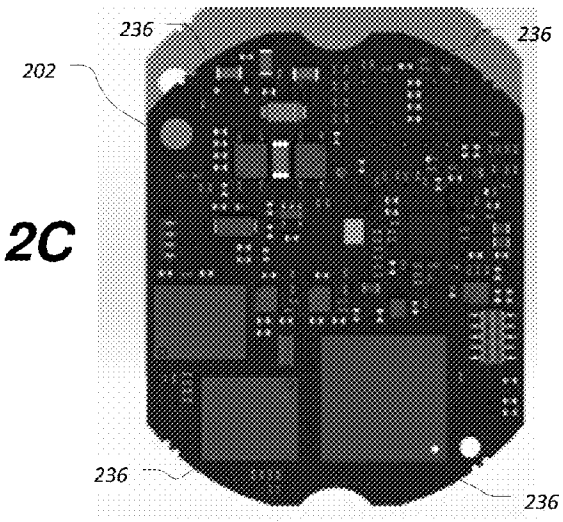
FIG. 2C illustrates an example front view of the main board of the controller, in accordance to one embodiment.
Figure 2D:
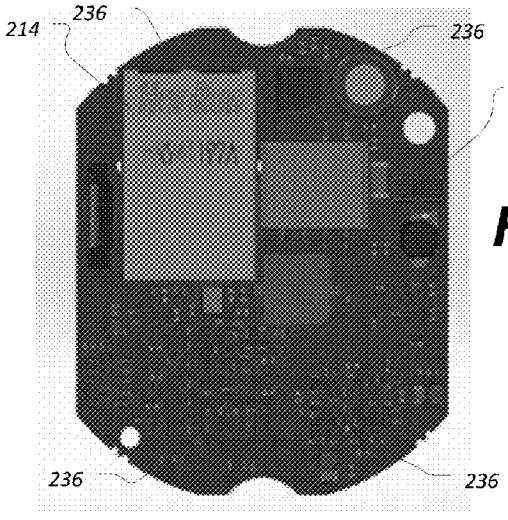
FIG. 2D illustrates an example back view of the main board of the controller, in accordance to one embodiment.

FIG. 2C illustrates an example front view of the main board 202 of the controller 116. As shown, the main board 202 includes rounded corners 236, allowing for the overall controller 116 to fit both into a standard U.S. electrical box, and also into a rounded European-style electrical box. FIG. 2D illustrates an example back view of the main board 202 of the controller 116. As shown, in addition to the rounded corners 236, the main board 202 includes a network interface 214 (e.g., an Ethernet jack) to which the main board 202 may be connected to the communications network 104. Notably, the location of the network interface 214 on the back-middle of the controller 116 allows for the network connection to be made to the controller 116 within the confines of an electrical box, while allowing for the network cable to stay within the maximum bend radius for the cable.

Figure 2E:
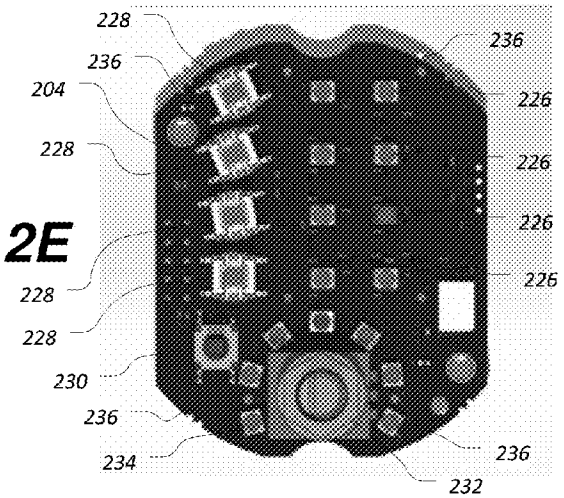
FIG. 2E illustrates an example front view of the front-panel board of the controller, in accordance to one embodiment.
Figure 2F:
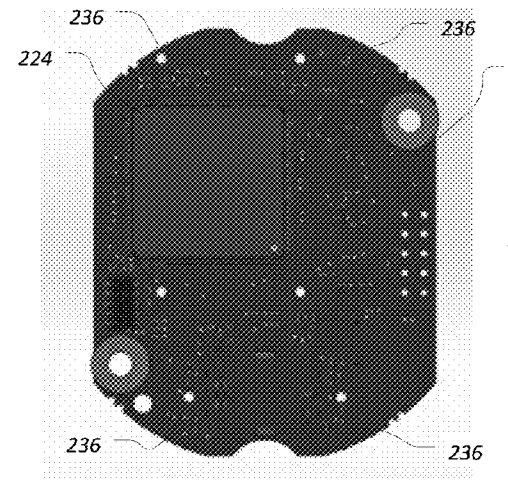
FIG. 2F illustrates an example back view of the front-panel board of the controller, in accordance to one embodiment.

FIG. 2E illustrates an example front view of the front-panel board 204 of the controller 116. As shown, the front-panel board 204 also includes rounded corners 236. Also as shown, the example front-panel board 204 includes display backlights 226, assignable buttons 228, a locator button 230, an encoder 232, and encoder backlights 234. FIG. 2F illustrates an example back view of the front-panel board 204 of the controller 116. As shown, the example back view illustrates the rounded corners and the programmable logic device 224.

Figure 2G:
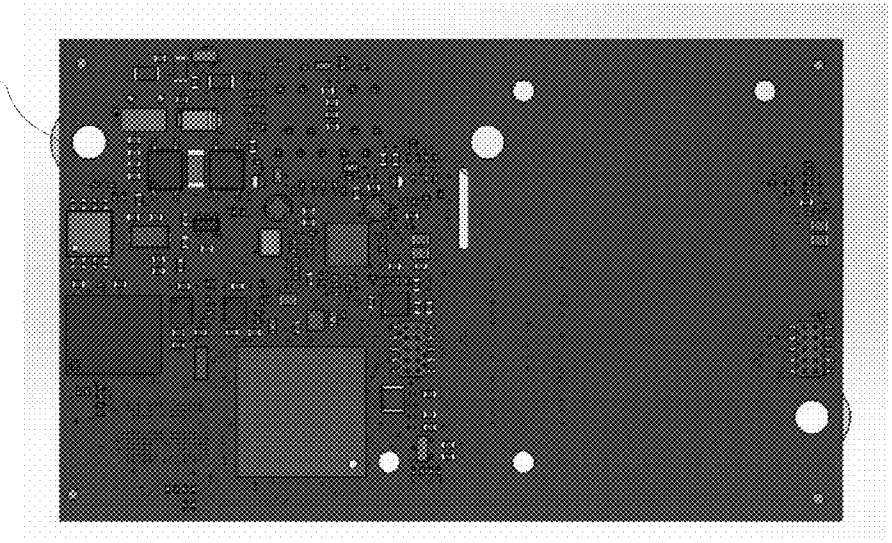
FIG. 2G illustrates an example front view of an alternate main board of the controller, in accordance to one embodiment.
Figure 2H:
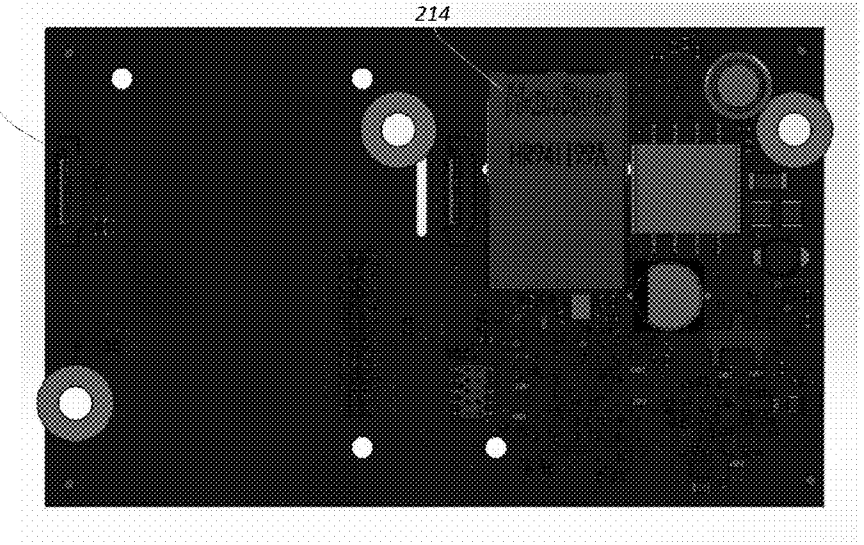
FIG. 2H illustrates an example back view of an alternate main board of the controller, in accordance to one embodiment.

FIG. 2G illustrates an example front view of an alternate main board 202 of the controller 116. FIG. 2H illustrates an example back view of an alternate main board 202 of the controller 116. As compared to the main board 202 illustrated in FIGS. 2C and 2D, the main board 202 of FIGS. 2G and 2H may be utilized in a controller 116 having multiple front-panel boards 204.

Figure 2I:
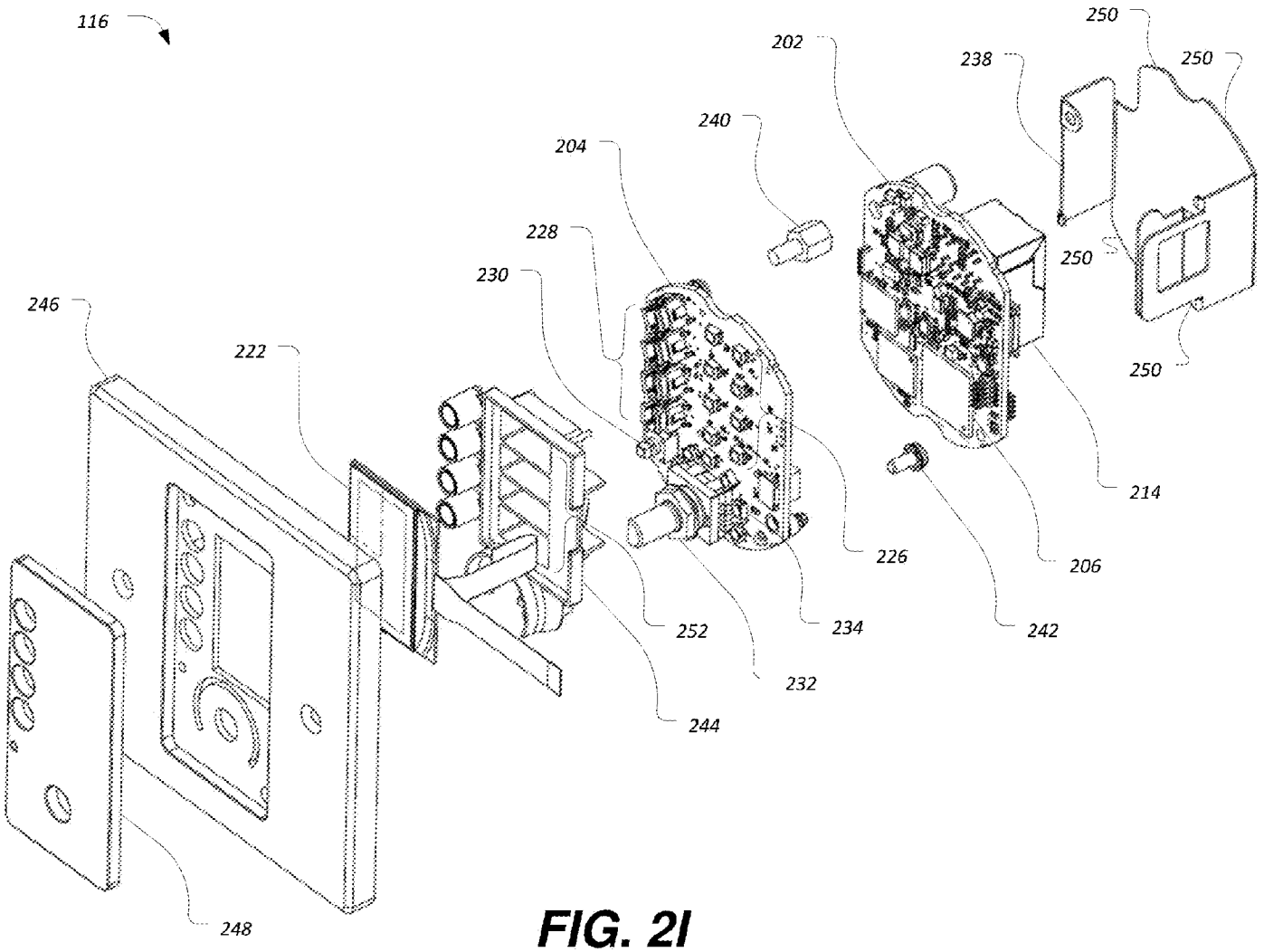
FIG. 2I illustrates an example exploded view of the components of the controller, in accordance to one embodiment.

FIG. 2I illustrates an example exploded view of the components of the controller 116. As shown, the controller 116 may include a shield 238 to which the main board 202 may be attached, followed by standoff 240 and spacer 242, followed by the front-panel board 204, followed by a screen holder 244, followed by the display screen 222, followed by the wall plate 246, followed by a lens 248. Notably, the shield 238 also has rounded corners 250, allowing for the overall controller 116 to fit into both standard U.S. electrical boxes and also rounded European-style electrical boxes. Moreover, the screen holder 244 further includes compartmentalized screen positions 252, allowing for the different screen positions 252 of the display screen 222 to be separately backlit by the elements of the display backlight 226.

Figure 2J:
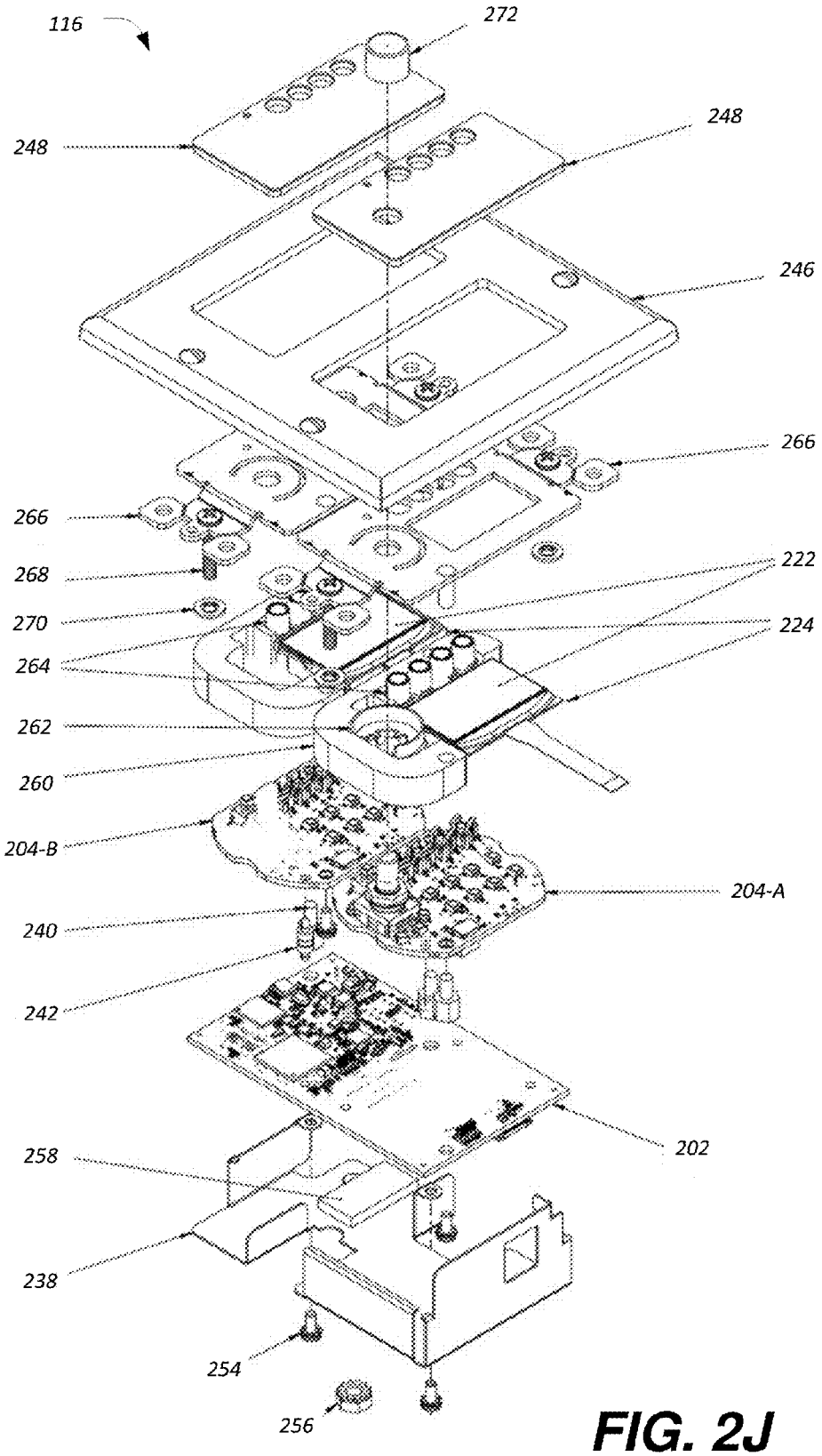
FIG. 2J illustrates an example exploded view of the components of the controller having multiple front-panel boards, in accordance to one embodiment.

FIG. 2J illustrates an example exploded view of the components of the controller 116 having multiple front-panel boards 204-A and 204-B. As shown, the controller 116 may include a shield 238 to which the main board may be attached, such as via screws 254, nuts 256, and/or tape 258. The controller 116 may also include one or more standoffs 240 and/or spacers 242 from the main board 202, followed by the front-panel boards 204-A and 204-B, followed by the screen holders 244, followed by the display screens 222. The screen holders 244 may include, for example, light shrouds 260, light rings 262, and switch caps 264. The controller 116 may also include a power box bracket 266 to which the wall plate 246 may be mounted, e.g., via one or more screws 268 and washers 270. The controller 116 may also include lenses 248 for each of the front-panel boards 204-A and 204-B, and a knob 272 for the front-panel boards 204-A having an encoder 232.

Figure 2K:
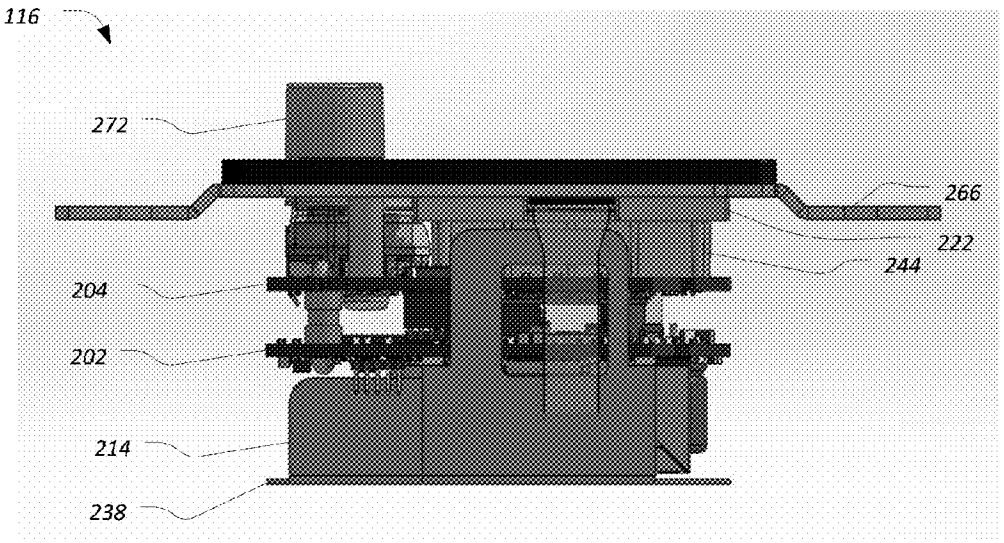
FIG. 2K illustrates an example right-side view of the controller as assembled, in accordance to one embodiment.
Figure 2L:
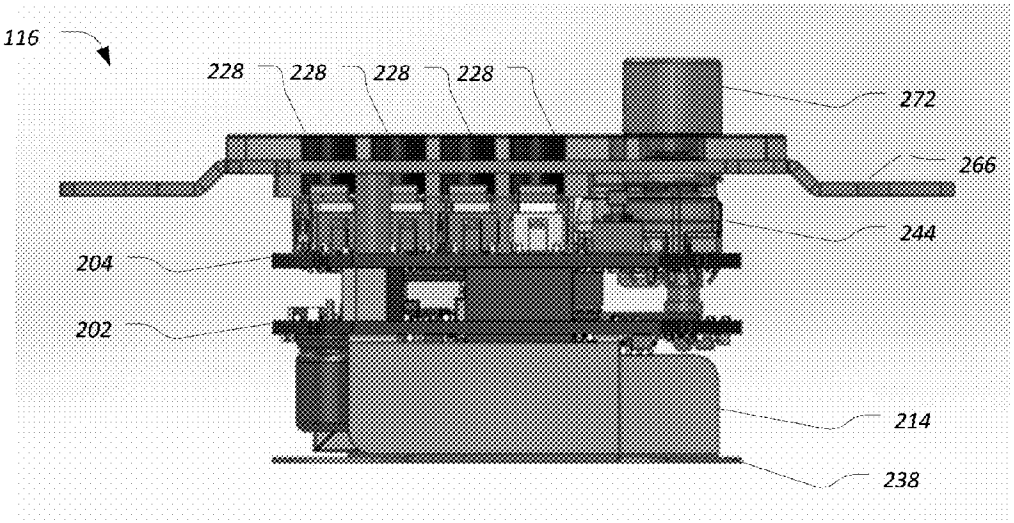
FIG. 2L illustrates an example left-side view of the controller as assembled, in accordance to one embodiment.
Figure 2M:
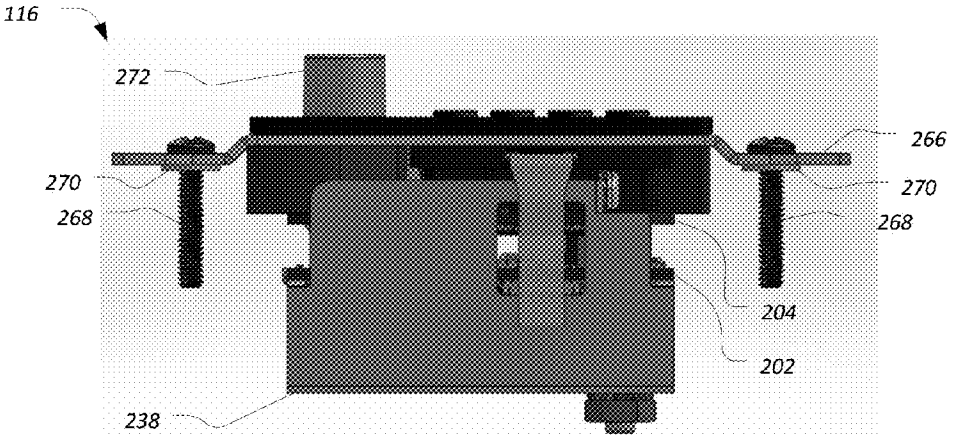
FIG. 2M illustrates an alternate example right-side view of the controller as assembled, in accordance to one embodiment.
Figure 2N:
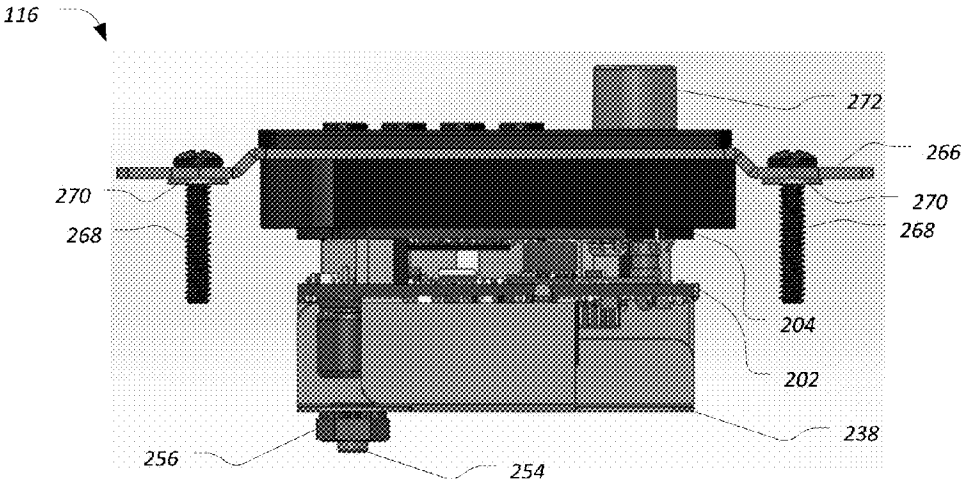
FIG. 2N illustrates an alternate example left-side view of the controller as assembled, in accordance to one embodiment.

FIG. 2K illustrates an example right-side view of the controller 116 as assembled, while FIG. 2L illustrates an example left-side view of the controller 116 as assembled. FIG. 2M illustrates an alternate example right-side view of the controller 116 as assembled, while FIG. 2N illustrates an alternate example left-side view of the controller 116 as assembled.

Figure 3B:
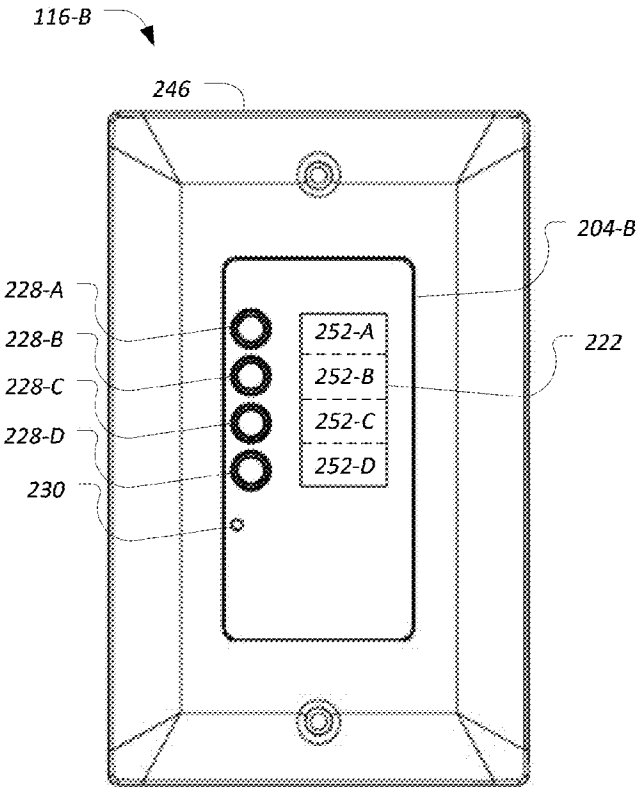
FIG. 3B illustrated an example front panel of a controller having four assignable buttons and a display screen, in accordance to one embodiment.
Figure 3A:
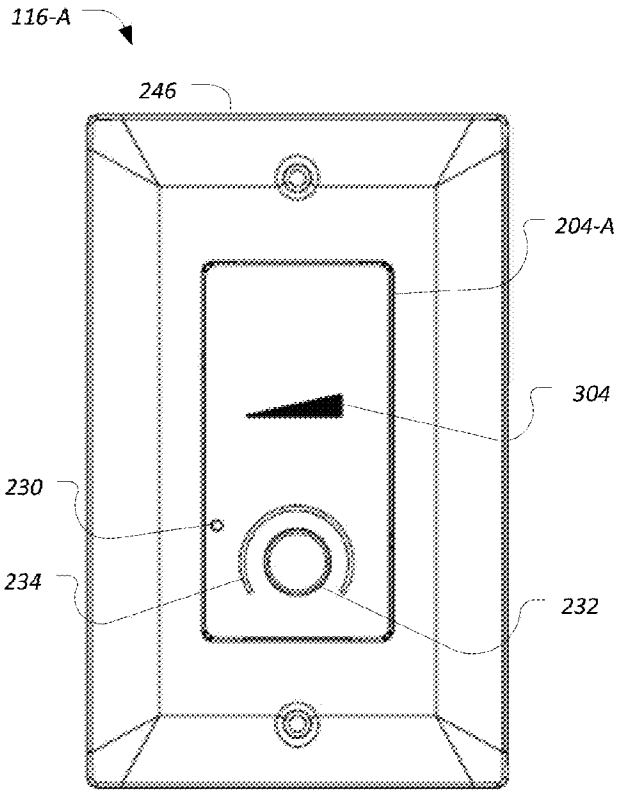
FIG. 3A illustrated an example front panel of a controller having an encoder but no assignable buttons, in accordance to one embodiment.

FIG. 3A illustrated an example front-panel board 204-A of a controller 116-A having an encoder 232 but no assignable buttons 228. The example front-panel board 204-A also includes a locator button 230. As shown, the controller 116-A is fitted within a wall plate 246, such as a single-gang U.S. DECORA® wall plate 246 or a single-gang European form factor wall plate 246. The front-panel board 204-A may further include descriptive information, for example, as volume indication 304 specifying the function of the controller 116-A.

As shown, the front-panel board 204-A includes one push/rotary encoder 232 and one encoder light control 234 in the form of a light ring. The encoder 232 may be rotated by a user to provide for continuous parameter control (e.g., volume). The rotary encoder 232 may also be pressed for binary parameter control (e.g., mute) or for other functions such as preset recall. The encoder light control 234 may also be backlit in a user-selectable color (e.g., a color indicative of the zone 112 or source being adjusted).

The encoder light control 234 may be configured to display a bouncing audio meter indicative of the level of media content being played back by the speakers 106 or zone 112 controlled by the controller 116. The specific parameter to be metered by the encoder light control 234 may be settable using the user interface of the control server 114. When the encoder 232 is rotated by the user to make an adjustment to a parameter (e.g., volume), the encoder light control 234 may temporarily display the value of the setting being adjusted (e.g. the volume setting). After a predetermined timeout period during which no further user input is received to the encoder 232 (e.g., one second, five seconds, thirty seconds, etc.), the encoder light control 234 may revert to the bouncing meter.

When the encoder 232 is pressed, the encoder light control 234 may temporarily display a binary parameter setting (e.g., red/green for muted/unmuted status) for a predetermined period of time (e.g., one second, five seconds, thirty seconds, etc.). In an example, a first push of the encoder 232 may show a current state of a binary parameter assigned to the push function of the encoder 232 on the encoder light control 234 and any subsequent push may toggle the state of the assigned parameter. As one possibility, an on color and an off color may be assigned to the push function (e.g., using the user interface of the control server 114), and the whole of the encoder light control 234 may be shown in the on color or the off color in accordance with the state of the assigned parameter.

The configuration information 118 for the controller 116-A may accordingly include up to one continuous parameter for control, one binary parameter or preset (with one color for each state), one parameter to be metered, and one backlight color. In an example, the setup of the configuration information 118 assignment of the continuous parameter, binary parameter, backlight colors, and/or other functions to the encoder 232 may be performed using the user interface of the control server 114.

In some examples, the controller 116 may also support a "sleep" mode. For example, after a configurable amount of time without user input, the controller 116 may be configured to turn off all backlights (e.g., the encoder light control 234 in the illustrated example of the controller 116-A but in other examples also the display backlight 226, backlighting from any assignable buttons 228, etc.). In an example, the configurable amount of time may be specified in the configuration information 118 for the controller 116. The "sleep" mode may be useful to avoid distraction in a dimly-lit environment. When the user again interacts with the controls of the controller 116-A (e.g., with the encoder 232), the user interaction may cause the controller 116-A to again activate the lighting of the controller 116-A. This may be referred to as "waking up" the controller 116.

In some examples, the controller 116 may support a "lockout" mode, such that user input received when the controller 116 is in the 'lockout' mode is ignored. The controller 116 may be remotely set into the "lockout" mode and out of the "lockout" mode via commands received over the communication network 104. In an example, the control server 114 may be configured to send a "lockout" command and/or an end "lockout" command to the controller 116. Notably, the controller 116 may be commanded to enter the "lockout" mode whether or not the controller 116 is in the "sleep" mode.

FIG. 3B illustrated an example front-panel board 204-B of a controller 116-B having four assignable buttons 228 and a display screen 222. As with the front-panel board 204-A, the example front-panel board 204-B also includes the locator button 230. However, in contrast to the front-panel board 204-A, the front-panel board 204-B does not include the encoder 232, encoder light control 234, or volume indication 304.

As shown, the front-panel board 204-B includes a first assignable button 228-A, a second assignable button 228-B, a third assignable button 228-C, and a fourth assignable button 228-D (collectively assignable buttons 228). Each assignable buttons 228 may be associated with a screen position 252 of the display screen 222 configured to display graphics or text descriptive of the associated assignable button 228. As shown, the assignable buttons 228 are illustrated in a vertical array adjacent to the display screen 222, with the first assignable button 228-A above the second assignable button 228-B, in turn above the third assignable button 228-C, in turn above the fourth assignable button 228-D. In such an example, the first assignable button 228-A may be associated with a first screen position 252-A of the display screen 222 adjacent to the first assignable button 228-A, the second assignable button 228-B may be associated with a second screen position 252-B of the display screen 222 adjacent to the first assignable button 228-B but below the first screen position 252-A, the third assignable button 228-C may be associated with a third screen position 252-C of the display screen 222 adjacent to the third assignable button 228-C and below the second screen position 252-B, and the fourth assignable button 228-D may be associated with a fourth screen position 252-D of the display screen 222 adjacent to the fourth assignable button 228-D and below the third screen position 252-C. It should be noted that the illustrated layout is only an example, other layouts may be used (e.g., a horizontal arrangement of assignable buttons 228, a grid of assignable buttons 228, layout in which the assignable buttons 228 and displays screen 222 are not located adjacent to one another, etc.).

As discussed above, the assignable buttons 228 and display screen 222 may be backlit. In an example, the assignable buttons 228 and the screen positions 252 of the display screen 222 may be configurable via the configuration information 118 to be backlit in various colors (e.g., the eight colors of red, yellow, green, cyan, blue, magenta, white and amber), and with adjustable intensity. The assignable buttons 228 and associated screen positions 252 may generally be backlit in the same color. For instance, when the first assignable button 228-A is configured to be backlit in green, the first screen position 252-A may also be configured to be backlit in green, and when the second assignable button 228-B is configured to be backlit in amber, the second screen position 252-B may also be configured to be backlit in amber.

Each of the assignable buttons 228 may be assigned to a binary parameter via the configuration information 118 (e.g., mute), a preset recall function, or a source selection (e.g., an input number or other identifier corresponding to one of the media content sources 102 of the media system 100). The assignment of the parameters of the configuration information 118 may be performed, in an example, using the user interface of the control server 114. The maximum intensity of the backlighting may also be adjustable using the user interface of the control server 114 and included in the configuration information 118 to suit ambient light levels surrounding the controller 116. Each of the assignable buttons 228 may also be assigned to a corresponding color in the configuration information 118, e.g., using the user interface of the control server 114. In an example, the color assignment may be used to signify different zones 112 or different parameters within a zone 112.

In some cases, the intensity of the backlighting of the assignable buttons 228 may be utilized to signify which assignable buttons 228 are in a selected state, and which are in a state of being available for selection. For instance, an assignable button 228 illuminated at a first intensity level may indicate an available source, preset or parameter, while an assignable button 228 illuminated at a second intensity level may indicate a currently selected source, preset or parameter. In many examples the first intensity level may be dimmer than the second intensity level, although other approaches are possible.

Similar to as mentioned above, the controller 116-B may support a "sleep" mode in which the backlighting is discontinued. Also similar to as mentioned above, the controller 116-B may support a "lockout" mode during which the controller 116 may be set to ignore user input received to the user interface controls of the controller 116. As the front-panel board 204-B of the controller 116-B includes the assignable buttons 228, in some examples the controller 116-B may be configured to be removable from the "lockout'" mode responsive to user input of a personal identification code (e.g., a four-digit code entered using the assignable buttons 228). Other user input to the controller 116-B, however, such as attempts to make adjustments using the encoder 232 may be ignored.

Figure 3D:
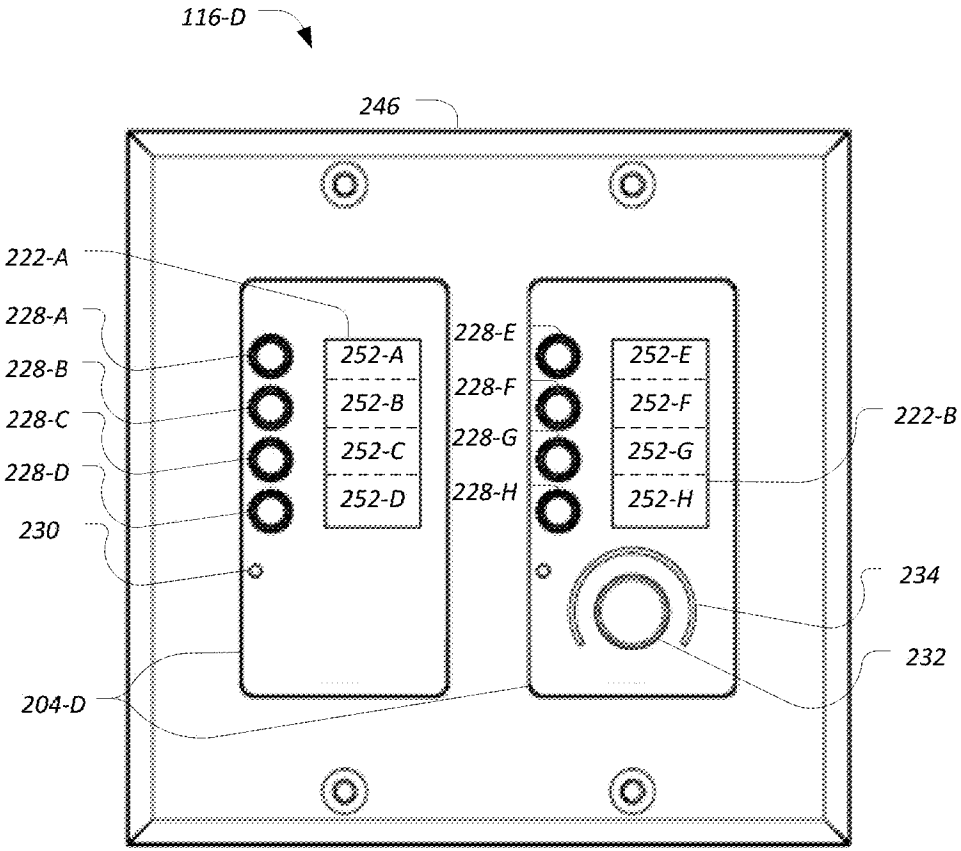
FIG. 3D illustrates an example front panel of a controller having eight assignable buttons, multiple display screens, and an encoder, in accordance to one embodiment.
Figure 3C:
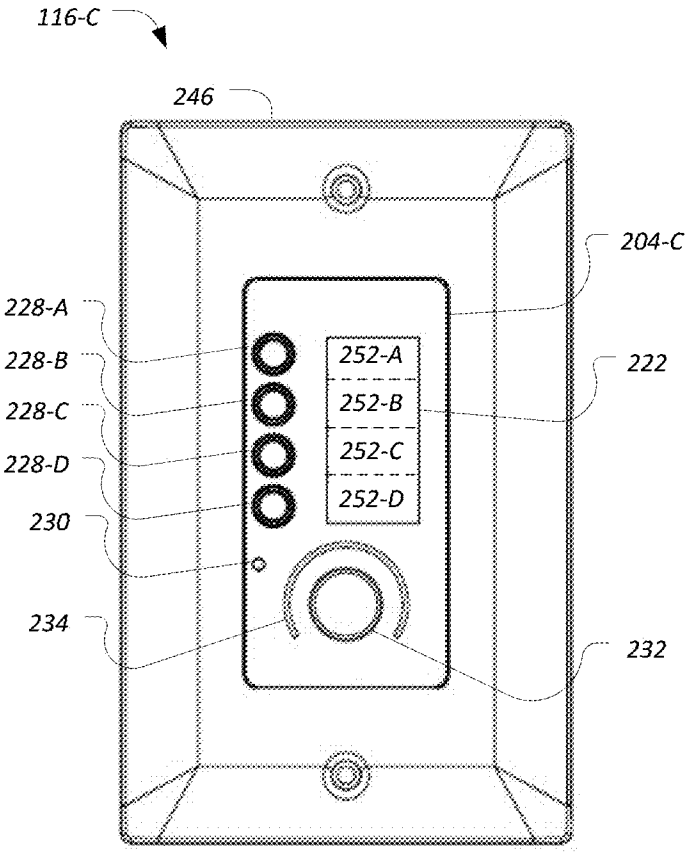
FIG. 3C illustrated an example front panel of a controller having four assignable buttons, a display screen, and an encoder, in accordance to one embodiment.

FIG. 3C illustrated an example front-panel board 204-C of a controller 116-C having four assignable buttons 228, a display screen 222, and an encoder 232. The example front-panel board 204-C also includes the locator button 230. Thus, the controller 116-C includes a superset of the controls of the controller 116-A and the controller 116-B, although with the exception of the volume indication 304 of the front-panel board 204-A.

Similar to as discussed above with respect to the controller 116-A, the encoder 232 of the controller 116-A may be a push/rotary encoder 232 that may be rotated for continuous parameter control (e.g. volume) and/or pressed for binary parameter control (e.g. mute) or preset recall. Also as discussed above, the encoder light control 234 may default to display a bouncing audio meter. When the push/rotary encoder 232 is rotated, the encoder light control 234 may temporarily display a volume setting, and when the push/rotary encoder 232 is pressed, the encoder light control 234 ring may temporarily display a binary parameter setting (e.g. red/green for muted/unmuted status). Similar to as discussed above with respect to the controller 116-B, the assignable buttons 228 of the controller 116-C may be pressed for binary parameter control (e.g. mute), preset recall, or source selection. Thus, the configuration information 118 for the controller 116-C may specify colors and parameters of the push/rotary encoder 232, and also colors, parameters, presents, zones 112, and associated push/rotary encoder 232 settings of the assignable buttons 228.

The controller 116-C may support additional features due to the inclusion of both the encoder 232 and the assignable buttons 228. For instance, in a single-zone mode, the controller 116-C may be configured to utilize the assignable buttons 228 to select binary parameters, presents, or sources within a zone 112. For each selected assignable button 228, the encoder 232 may be assigned a continuous parameter, the encoder light control 234 may be assigned a parameter to meter, and the encoder 232 pushbutton may be assigned a binary parameter. As one example, each of the assignable buttons 228 may be assigned a source, such that when the assignable buttons 228 is selected, the encoder 232 and encoder light control 234 facilitate metering and volume control for the selected source. Thus, the controller 116-C in the single-zone mode may support source selection using the assignable buttons 228 and volume control of the selected source using the encoder 232.

In a multiple-zone mode, the controller 116-C may be configured to utilize the assignable buttons 228 to select different zones 112. Within each selected zone 112, the encoder 232 may be assigned a continuous parameter, the encoder light control 234 may be assigned a parameter to meter, and the encoder 232 pushbutton may be assigned a binary parameter. Moreover, each of the assignable buttons 228 may be assigned a different backlight color corresponding to the particular zone 112, such that when one of the assignable buttons 228 is selected, the encoder 232 and encoder light control 234 are backlit in the color of the zone 112 of the selected assignable button 228. Accordingly, the backlight colors may provide a visual indication of which of the zone 112 is currently assigned to the encoder 232 for configuration. Thus, in the multiple-zone mode, the encoder 232 may be used to adjust a continuous parameter and/or binary parameter for four different zones 112. As an example use of the multiple-zone mode, the controller 116-C may support zone 112 selection using the assignable buttons 228 and volume control of the selected zone 112 using the encoder 232.

In a hybrid mode, the controller 116-C may function as a combination of the single-zone and multiple-zone modes. For instance, in the hybrid mode each of the assignable buttons 228 may be set to operate either for a direct function access as in single-zone mode, or for zone selection of the encoder 232 as done in the multiple-zone mode.

Figure 4A:
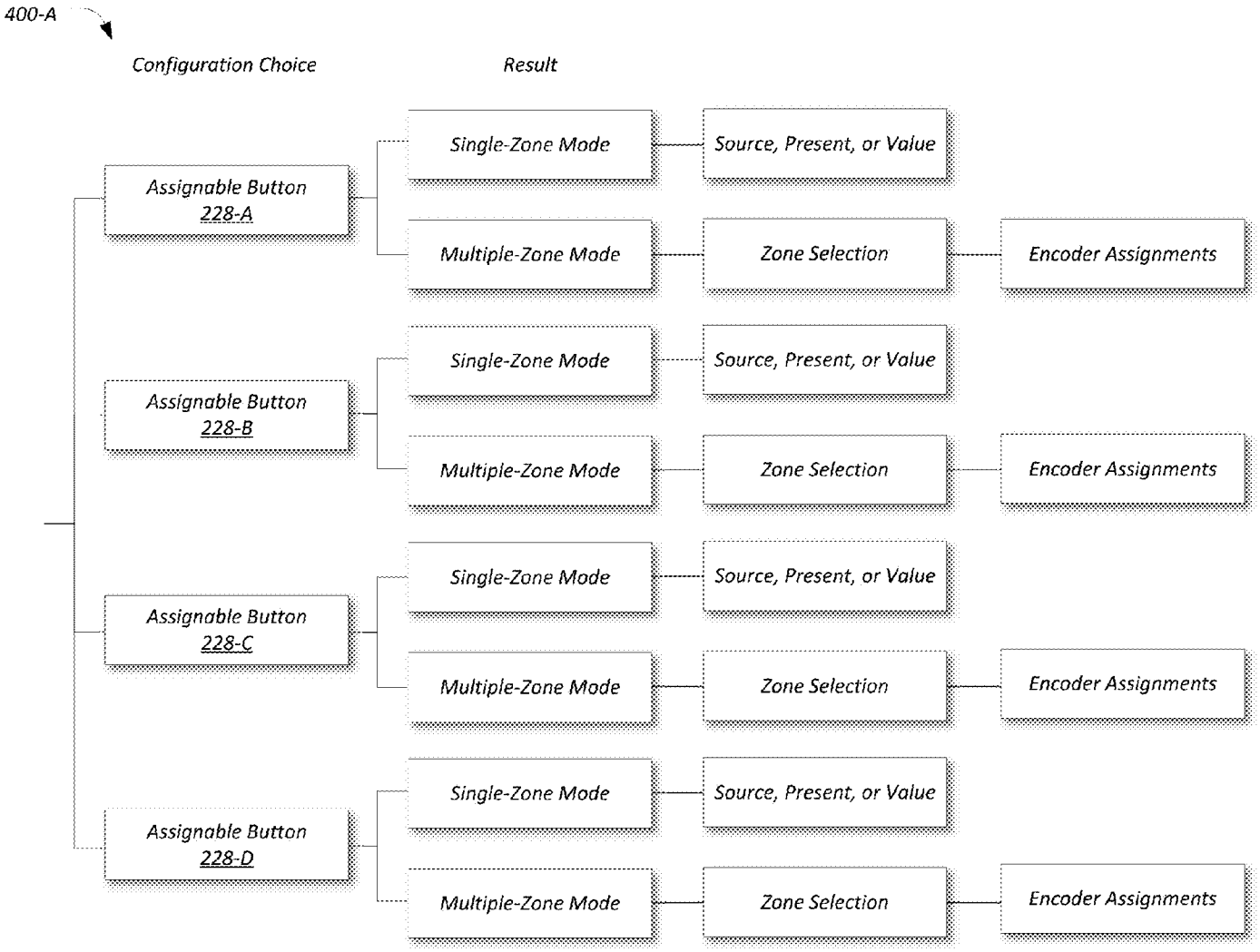
FIG. 4A illustrates a representation of possible single-zone and multiple-zone assignments for four assignable buttons, in accordance to one embodiment.

A representation 400-A of possible single-zone and multiple-zone configuration information 118 for four assignable buttons 228 is illustrated in FIG. 4A. As shown in FIG. 4A, each of the assignable buttons 228-A, 228-B, 228-C and 228-D may be set up as a single-zone mode assignable button 228 (for assignment to a source, preset, or value), or as a multiple-zone mode (for assignment to a zone 112). These configuration information 118 assignments may be configurable using the control server 114 and included in the configuration information 118 provided to the controller 116.

FIG. 3D illustrates an example front-panel board 204-D of the controller 116-D having eight assignable buttons 228, multiple display screens 222, and an encoder 232. Thus, the front-panel board 204-D illustrates a controller 116 similar to that of the front-panel board 204-C, but with additional assignable buttons 228 and screen positions 252. Due to the increased size of the layout of the front-panel board 204-D, the controller 116 is illustrated as fitted within a dual gang wall plate 246, such as a dual-gang U.S. DECORA® wall plate 246 or a dual-gang European form factor wall plate 246.

As with the controller 116-C, the controller 116-D may operate in various modes of operation. For instance, the controller 116-D may support a single-zone mode, although with eight assignable buttons 228 instead of four as used by the controller 116-C. The single-zone mode may be used, for example, for source selection and volume control for a single zone 112.

As another example, the controller 116-D may support a multiple-zone mode, although with up to eight zones 112 as compared to the four zones 112 that may be selectable using the controller 116-C. The multiple-zone mode may be used, for example, for volume control for eight zones 112.

The controller 116-D may further support additional modes due to the increased number of assignable buttons 228 of the controller 116-D as compared to the controller 116-C. For instance, the controller 116-D may support banked modes in which a selection is made by a sequence of multiple of the assignable buttons 228.

For instance, the controller 116-D may support a four-zone mode in which the assignable buttons 228-A through 228-D may be used to select a zone 112, and the assignable buttons 228-E through 228-H may be used to select a source and volume from the selected zone 112. Such a mode may be useful, for example, for performing source selection and volume control for four zones 112 (e.g., using assignable buttons 228-A through 228-D to select a zone 112, assignable buttons 228-E through 228-H to select a source for the selected zone 112, and the encoder 232 to select a volume or level of mix for the selected source in the selected zone 112).

As another example, the controller 116-D may support a four-by-four mode in which each of the assignable buttons 228-A through 228-D may be used to select a zone 112, and each of the assignable buttons 228-E through 228-H may be used to select a sub-zone 112 or parameter of the selected zone 112. Thus, the encoder 232 may be used to adjust a parameter from a select one of up to sixteen zones using the controller 116-D.

As yet a further example, and similar to as discussed above with respect to the controller 116-C, the controller 116-D may also support a hybrid mode in which each of the assignable buttons 228-A through 228-D may be individually assigned to operate either as within the four-zone mode of the controller 116-D or within the four-by-four mode of the controller 116-D.

Figure 4B:
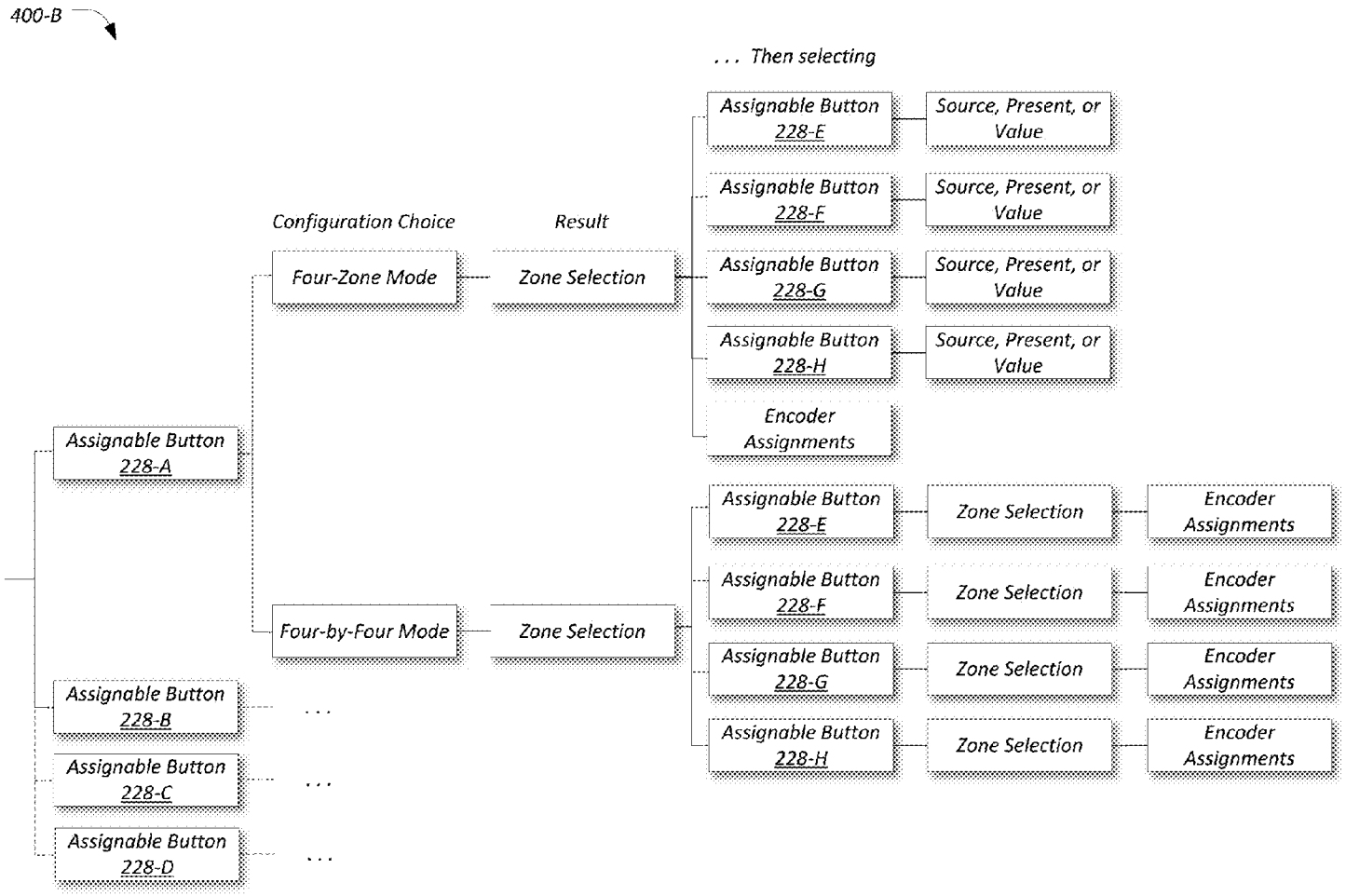
FIG. 4B illustrates a representation of a portion of the possible assignments for the assignable buttons of a controller having eight assignable buttons, in accordance to one embodiment.

A representation 400-B of a portion of the possible configuration information 118 assignments for the assignable buttons 228 of the controller 116-D is illustrated in FIG. 4B. As shown in FIG. 4B, the assignable buttons 228-A may be set up as a four-zone mode assignable button 228 or a four-by-four mode assignable button 228. Similar configuration options may be available for the assignable buttons 228-B, 228-C and 228-D, although not illustrated in the representation 400-B due to space considerations. These configuration information 118 assignments may be configurable using the control server 114 and included in the configuration information 118 provided to the controller 116.

Figure 5B:
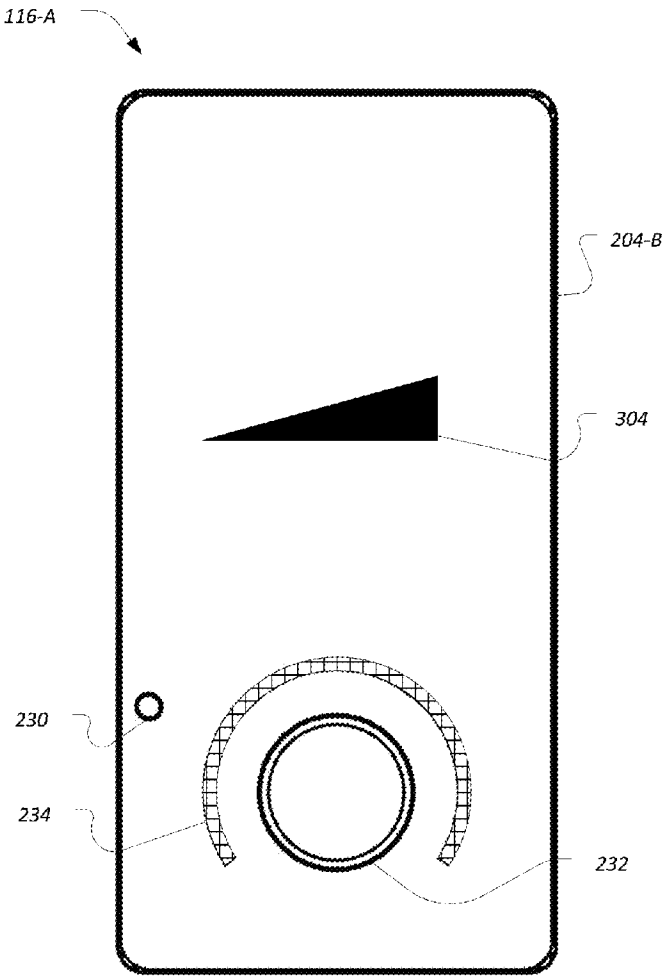
FIGS. 5A and 5B illustrates example controllers having an encoder for adjusting a continuous parameter, in accordance to one embodiment.
Figure 5A:
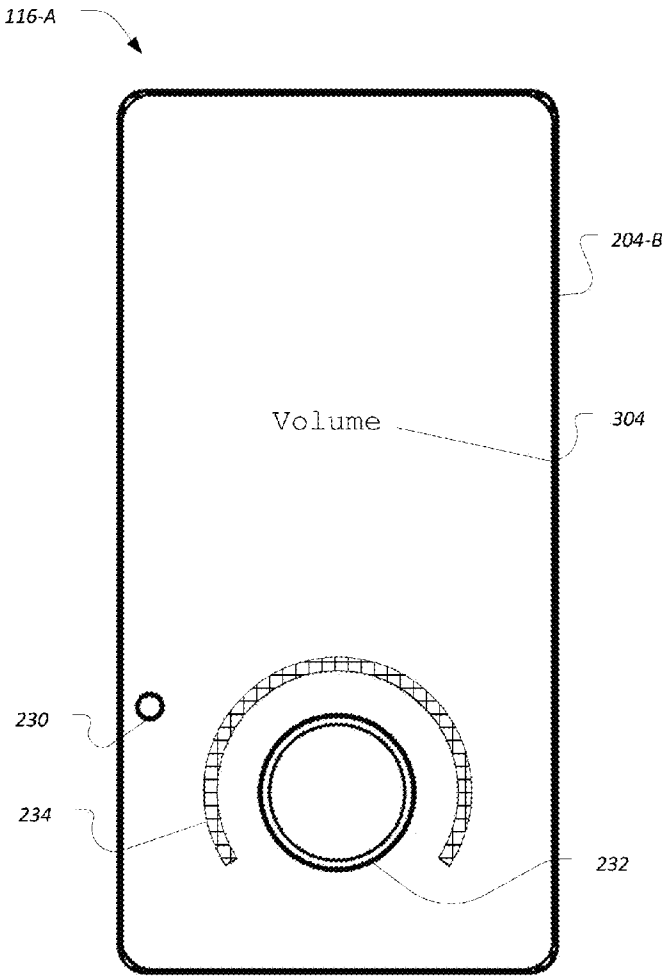
Figure 5D:
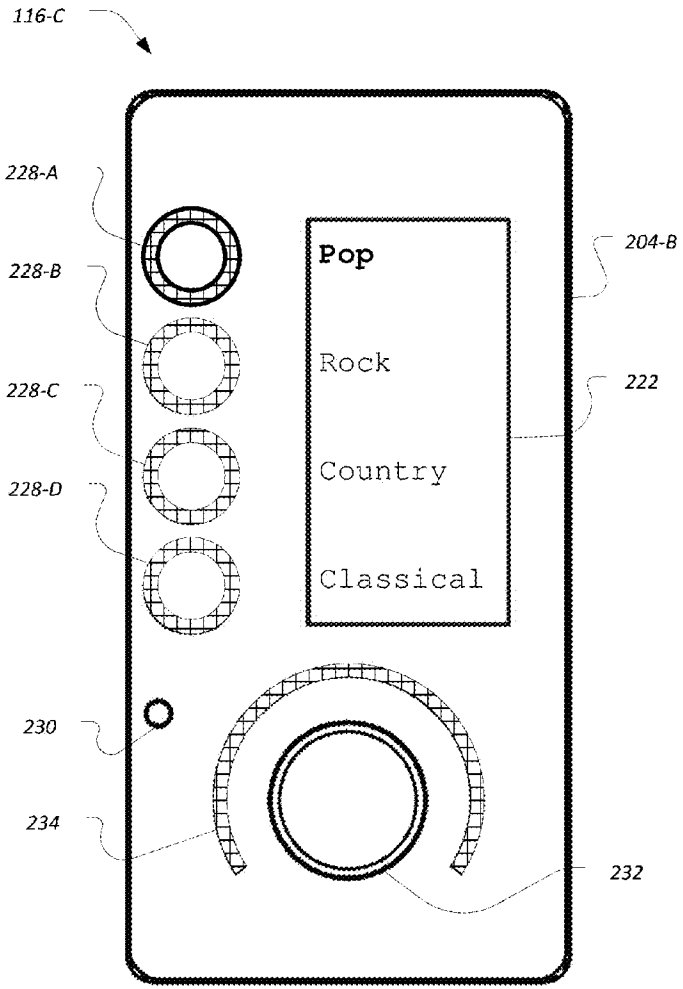
FIG. 5D illustrates an example controller having four assignable buttons and an encoder and operating in a single-zone mode, in accordance to one embodiment.
Figure 5C:
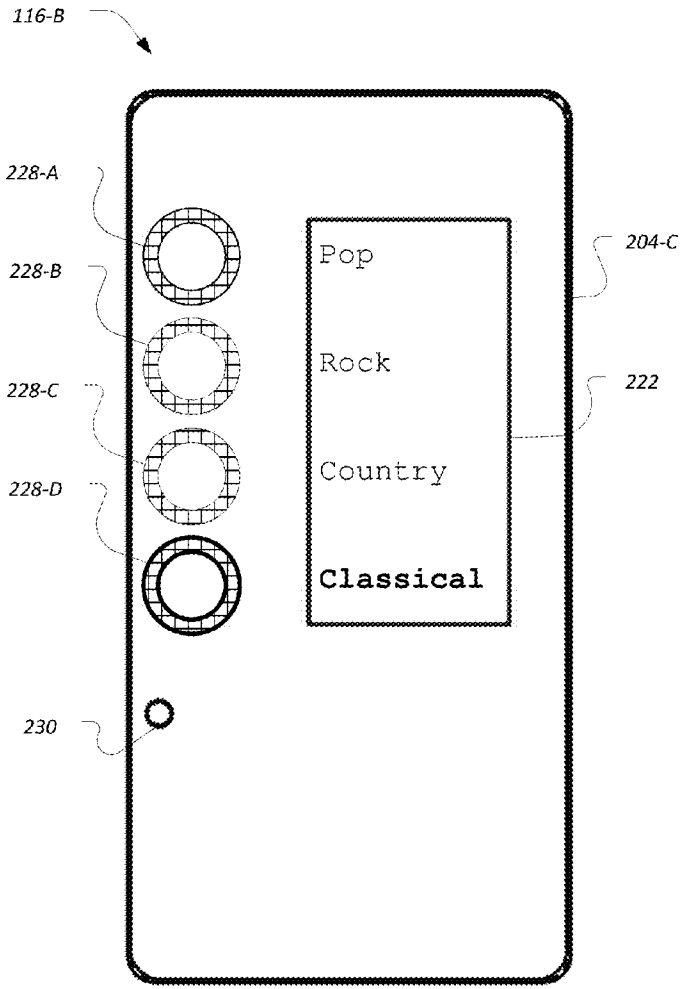
FIG. 5C illustrates an example controllers having four assignable buttons and operating to provide source selection for a zone, in accordance to one embodiment.
Figure 5F:
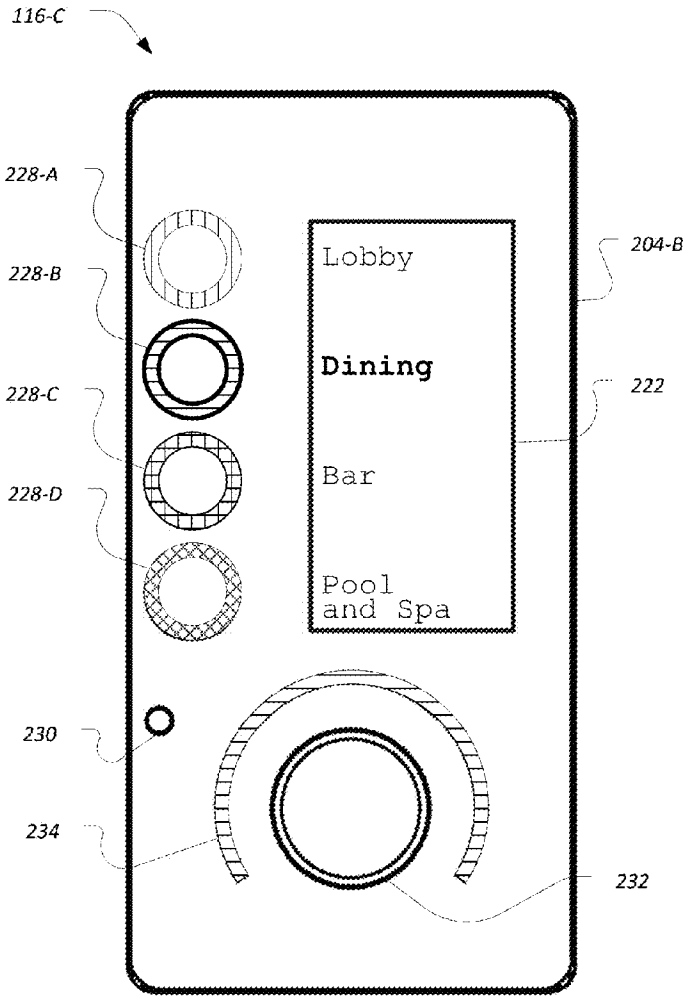
FIGS. 5E-5H illustrate example controllers having four assignable buttons and an encoder and operating in a four-zone mode, in accordance to one embodiment.
Figure 5E:
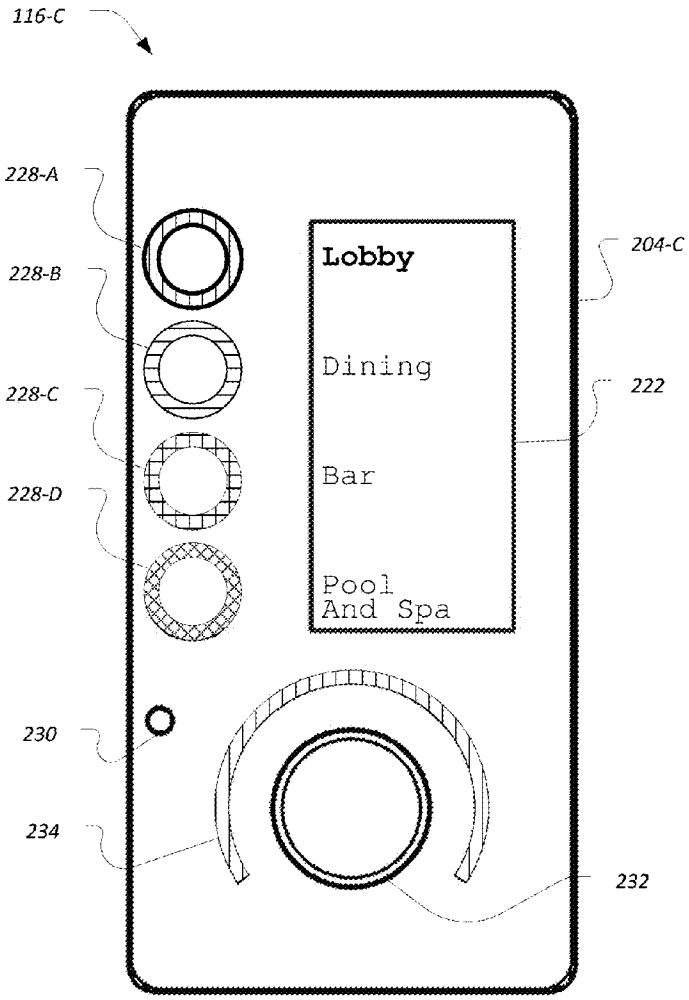
Figure 5H:
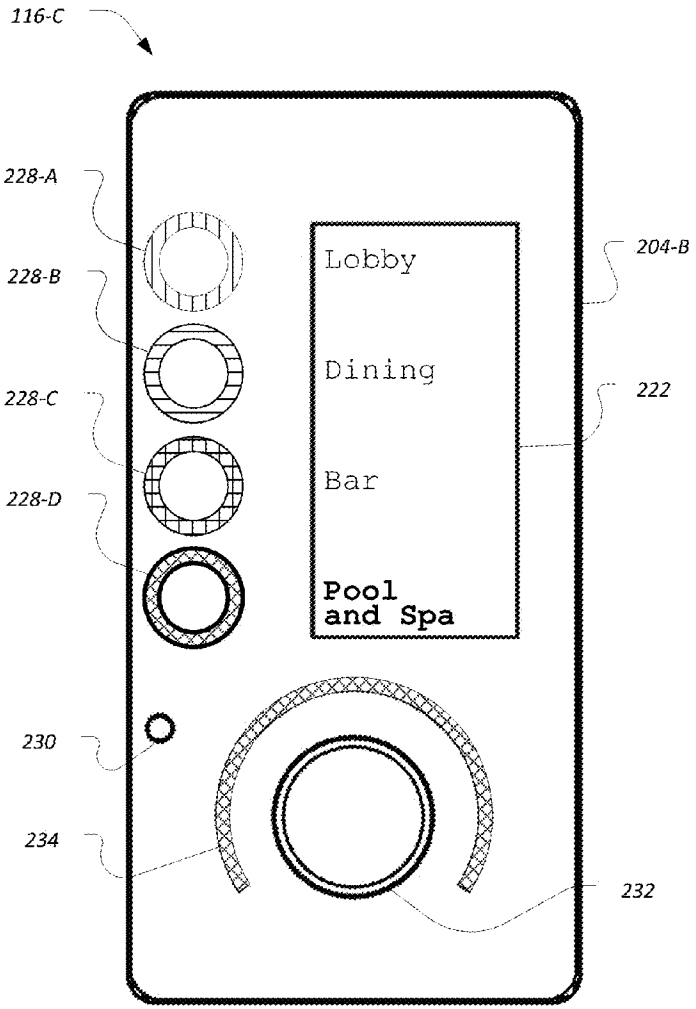
Figure 5G:
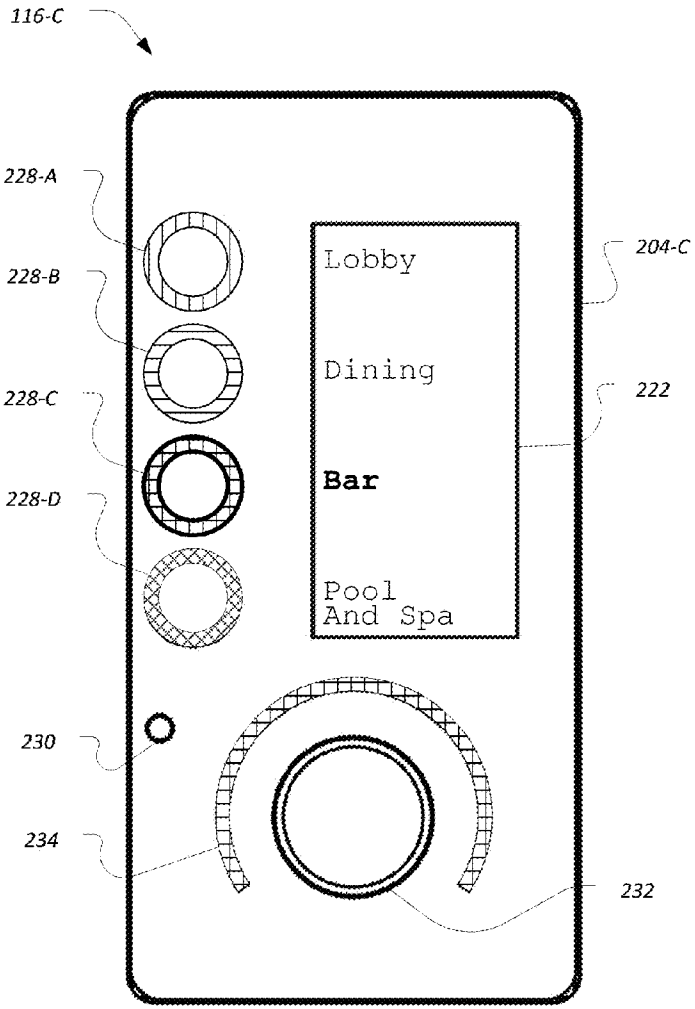
Figure 5J:
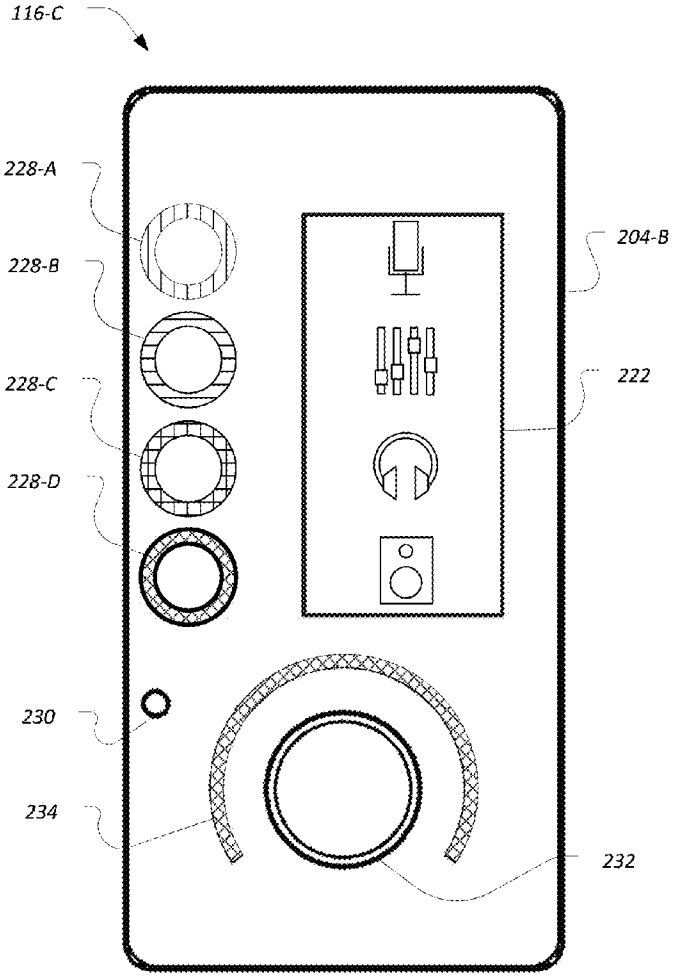
FIG. 5J illustrate an example controller displaying graphical information in the display screen, in accordance to one embodiment.
Figure 5I:
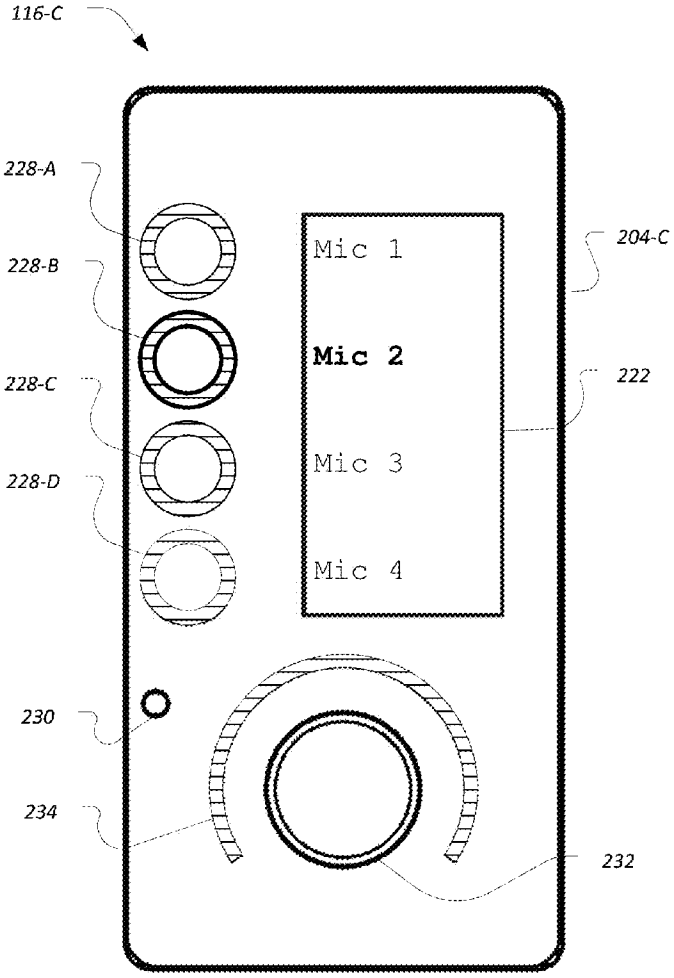
FIG. 5I illustrate an example controller having four assignable buttons and an encoder and operating in a single-zone mode to facilitate configuration of a mix for the zone, in accordance to one embodiment.
Figure 5K:
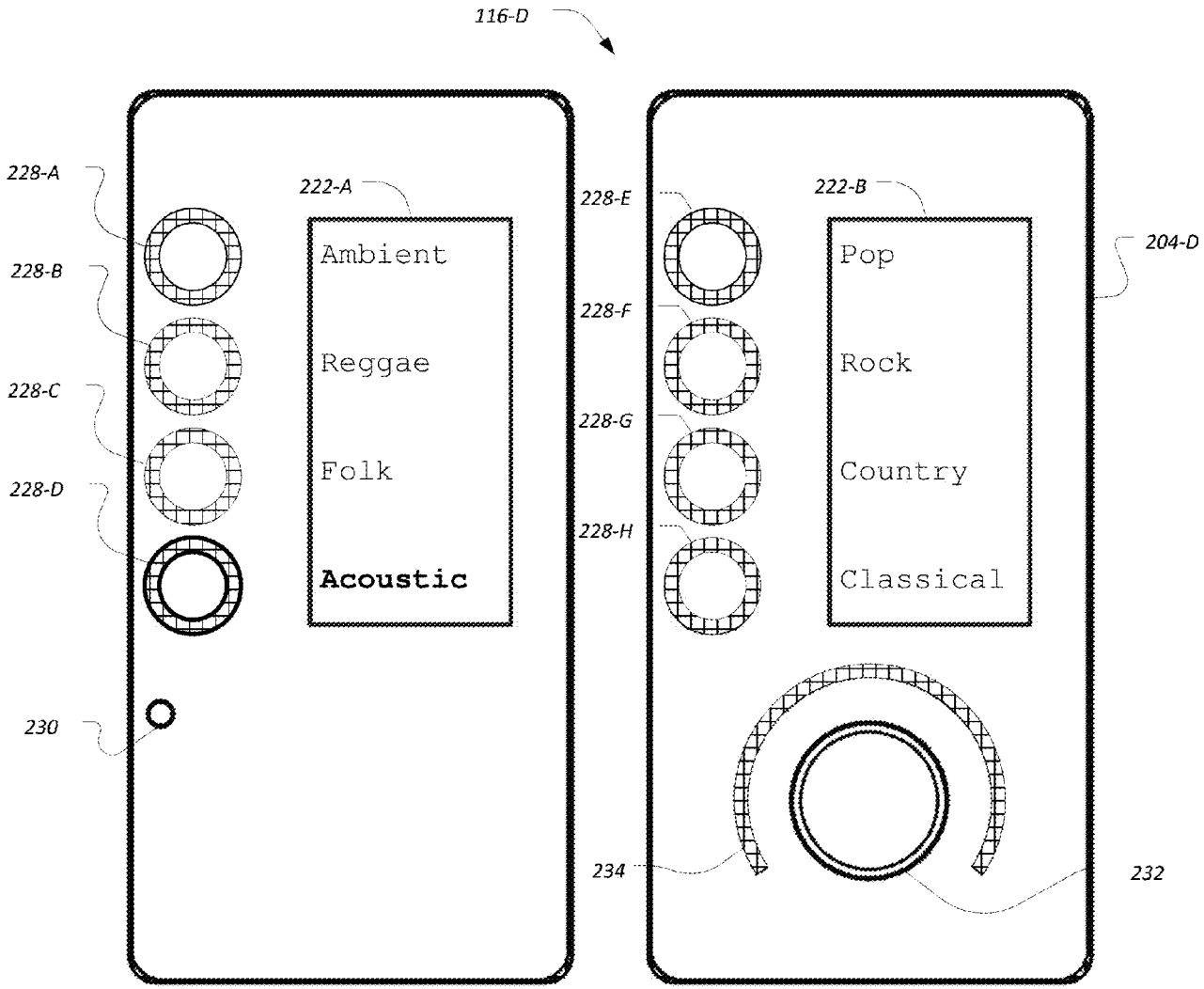
FIG. 5K illustrates an example controller having eight assignable buttons and an encoder and operating in a single-zone mode, in accordance to one embodiment.
Figure 5L:
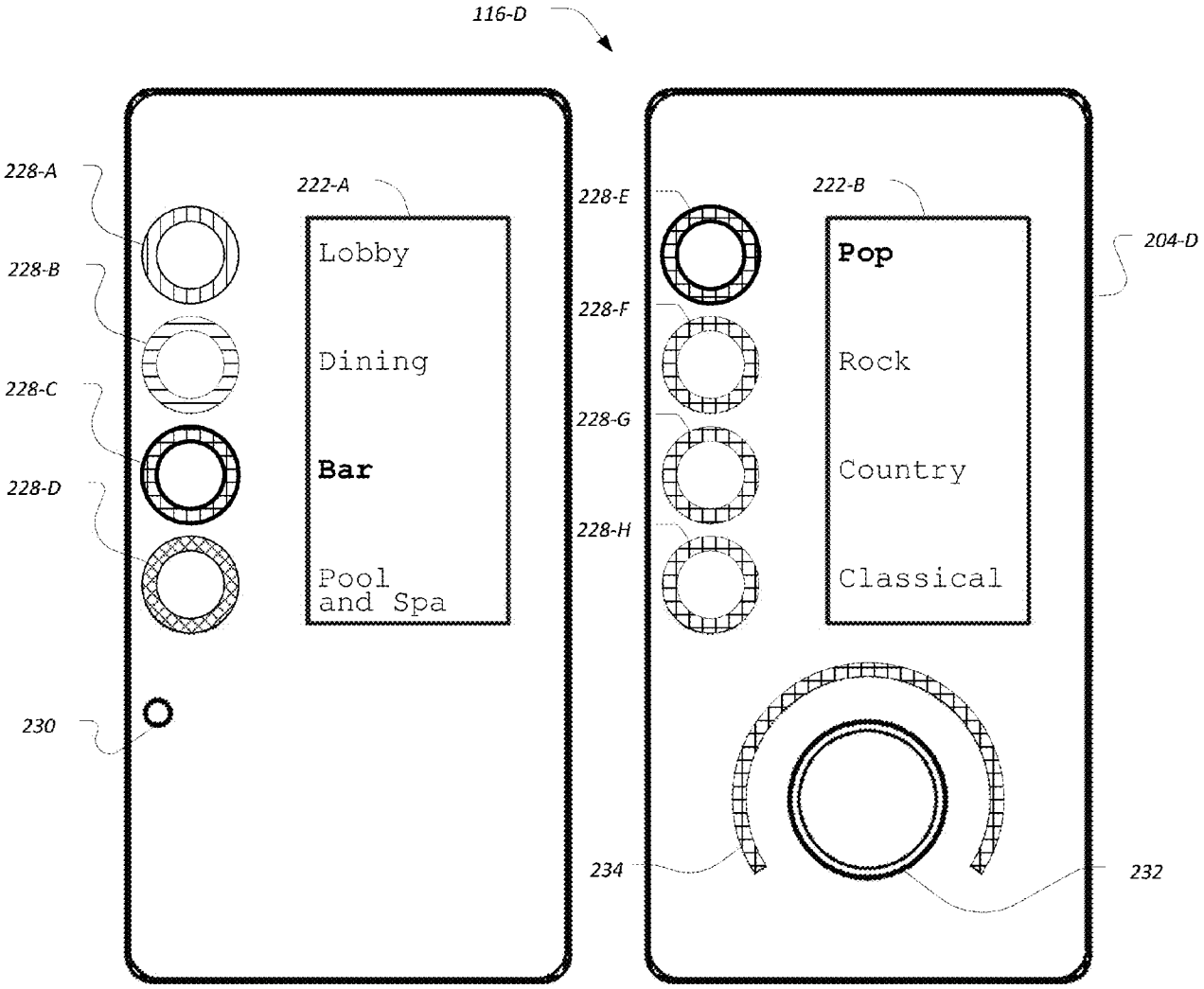
FIGS. 5L-5M illustrate example controllers having eight assignable buttons and an encoder and operating in a four-zone mode, in accordance to one embodiment.
Figure 5M:
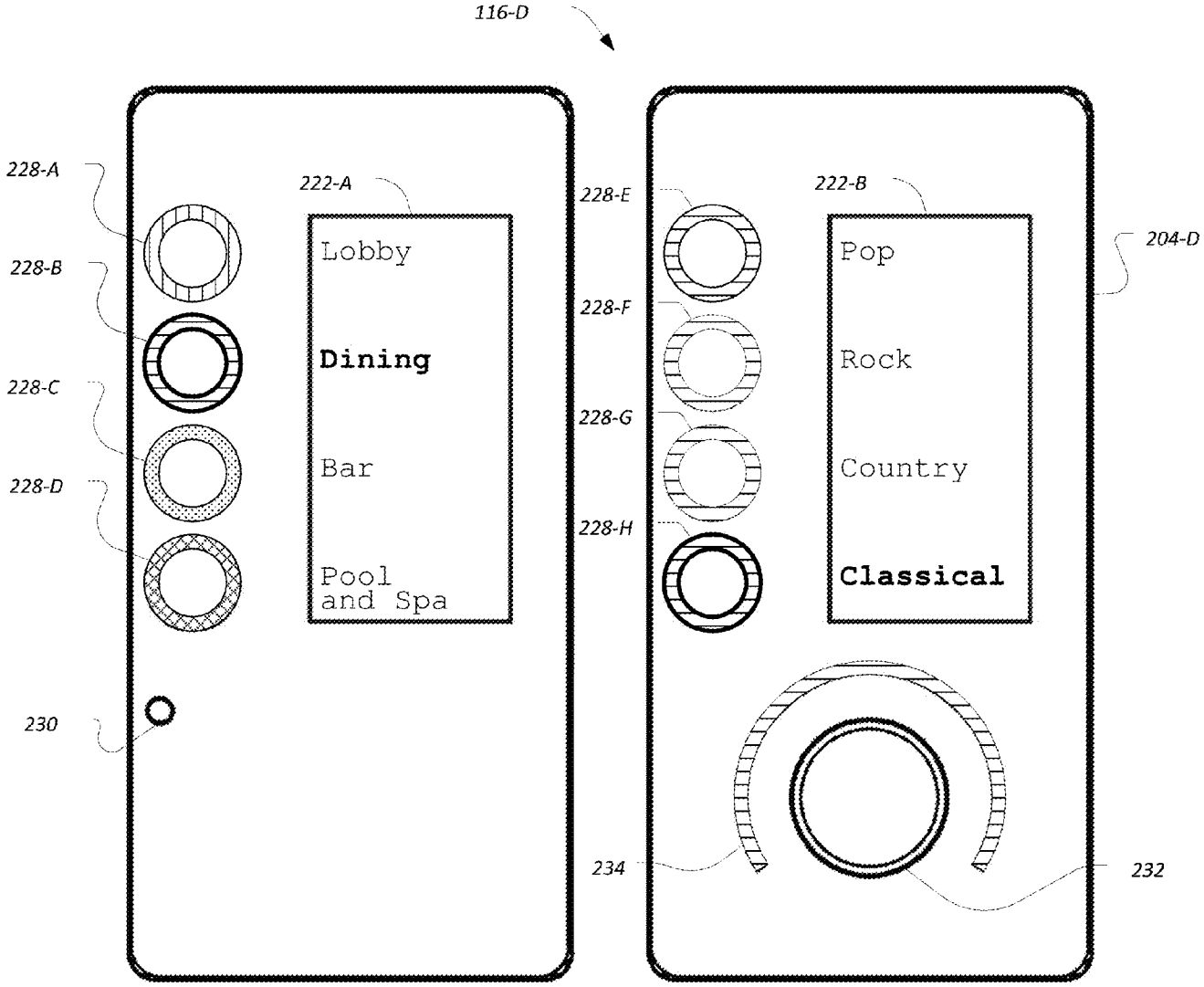
Figure 5N:
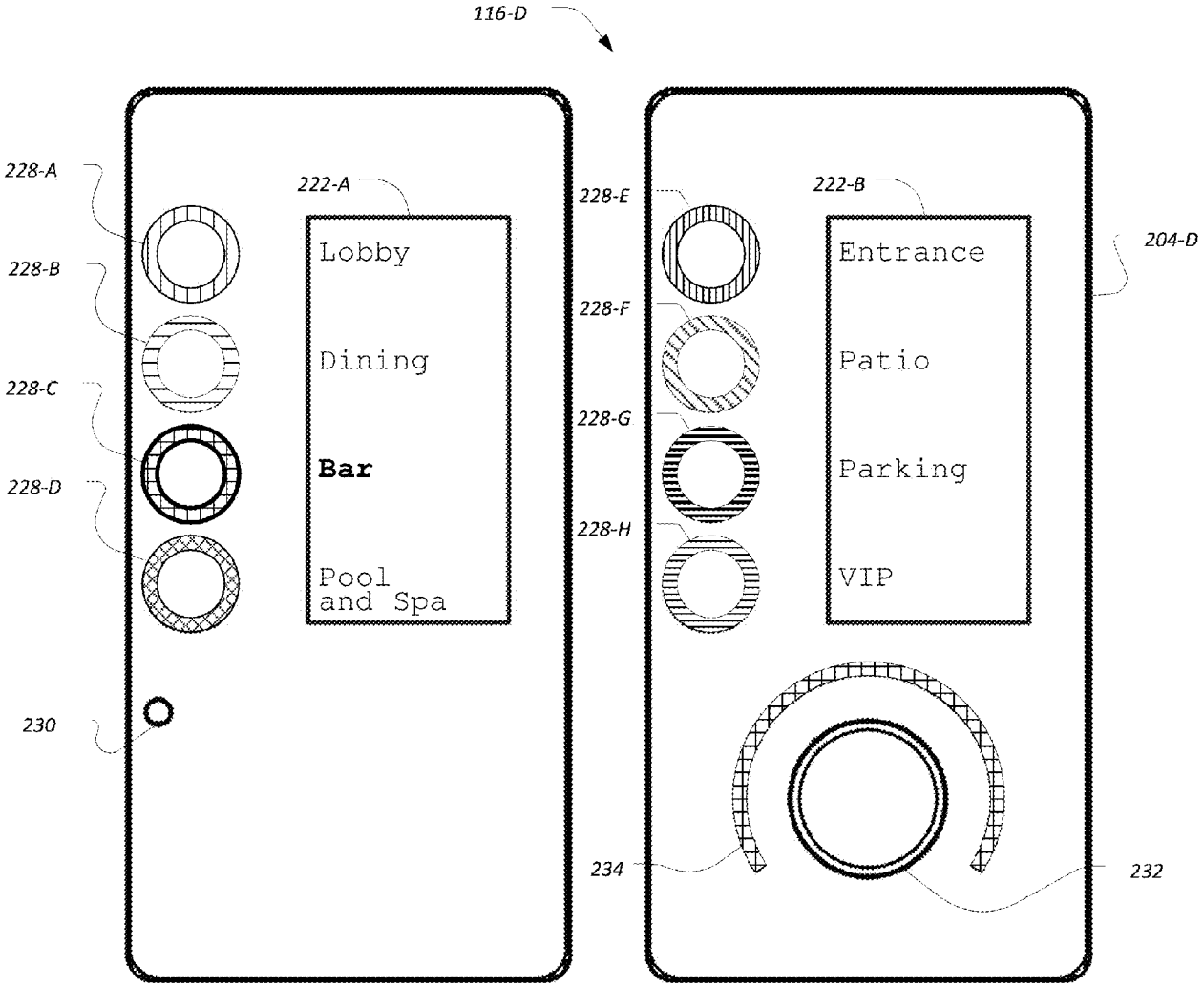
FIGS. 5N-5O illustrate example controllers having eight assignable buttons and an encoder and operating in an eight-zone mode, in accordance to one embodiment.
Figure 5O:
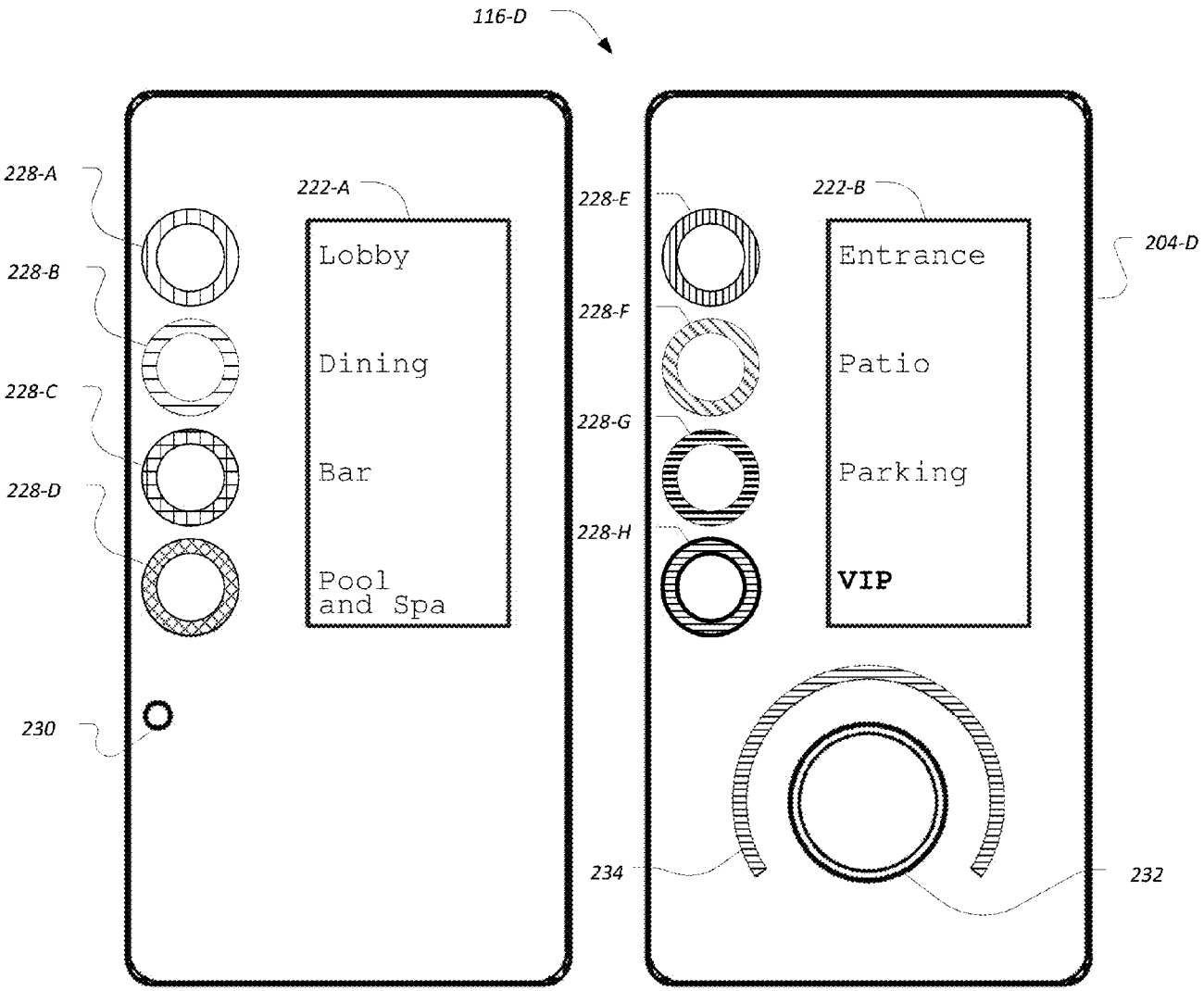
Figure 5P:
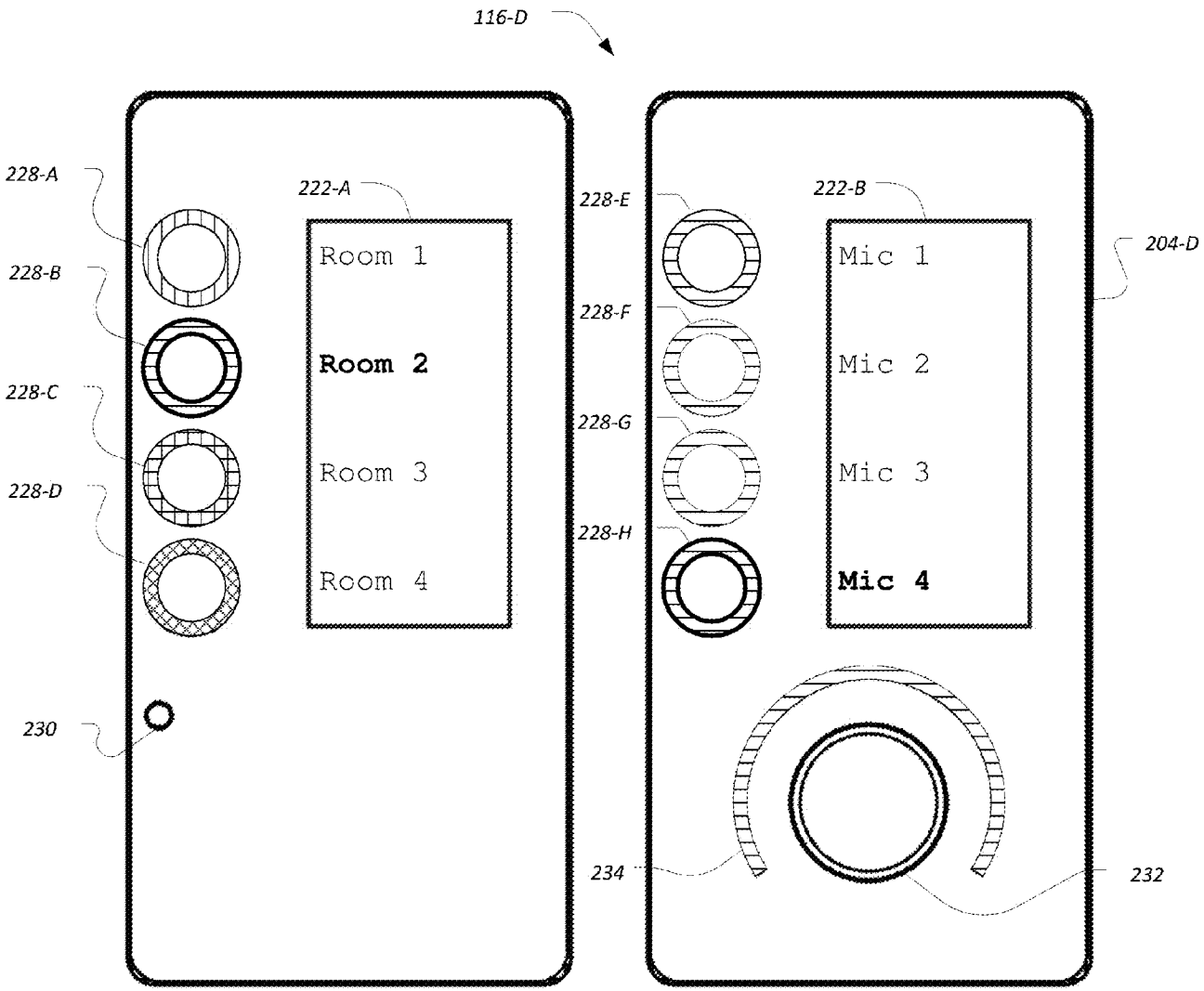
FIGS. 5P-5Q illustrate example controllers having eight assignable buttons and an encoder and operating in an four-by-four-zone mode, in accordance to one embodiment.
Figure 5Q:
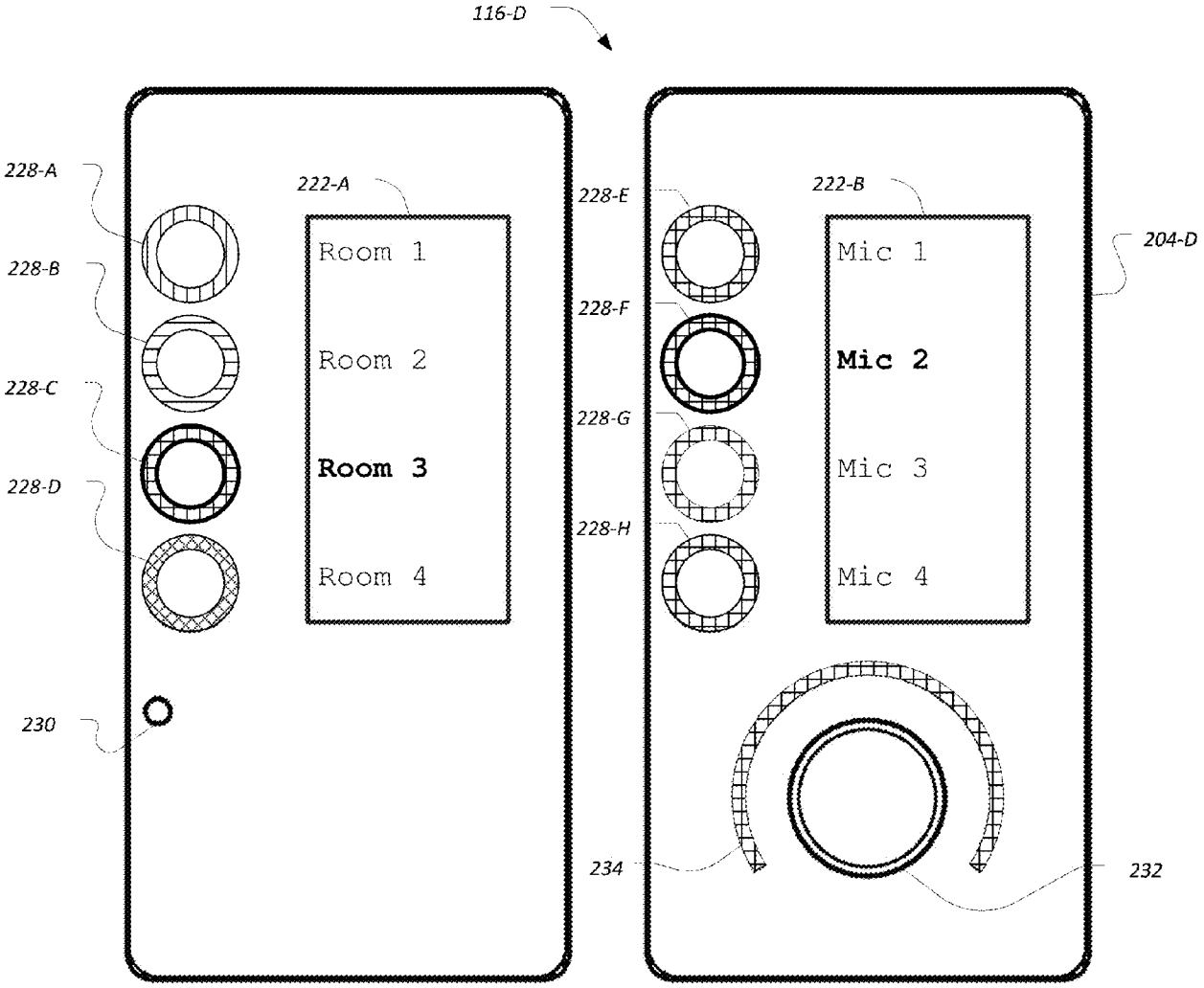
Figure 5R:
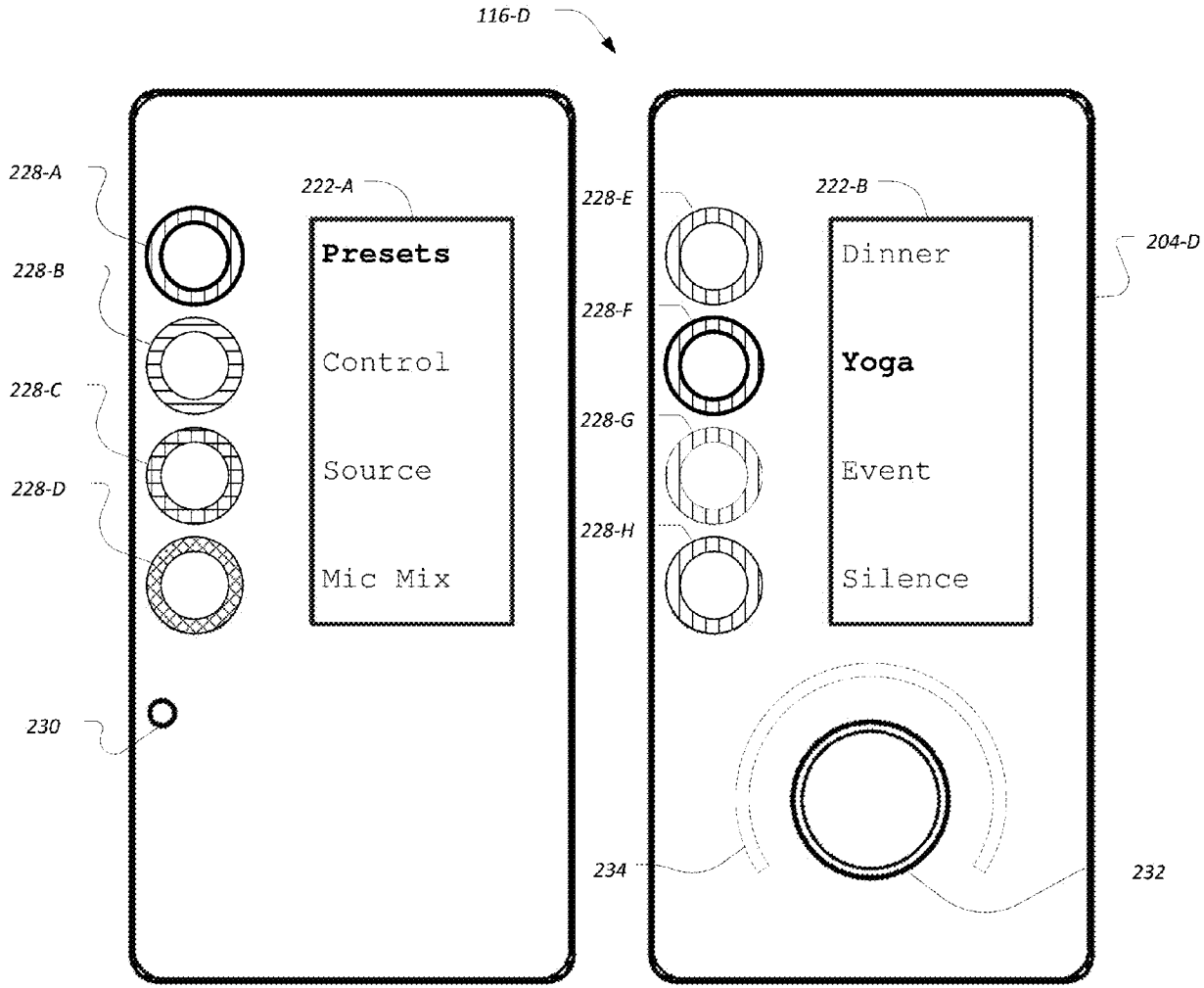
FIGS. 5R-5U illustrate example controllers having eight assignable buttons and an encoder and operating in a hybrid mode, in accordance to one embodiment.
Figure 5S:
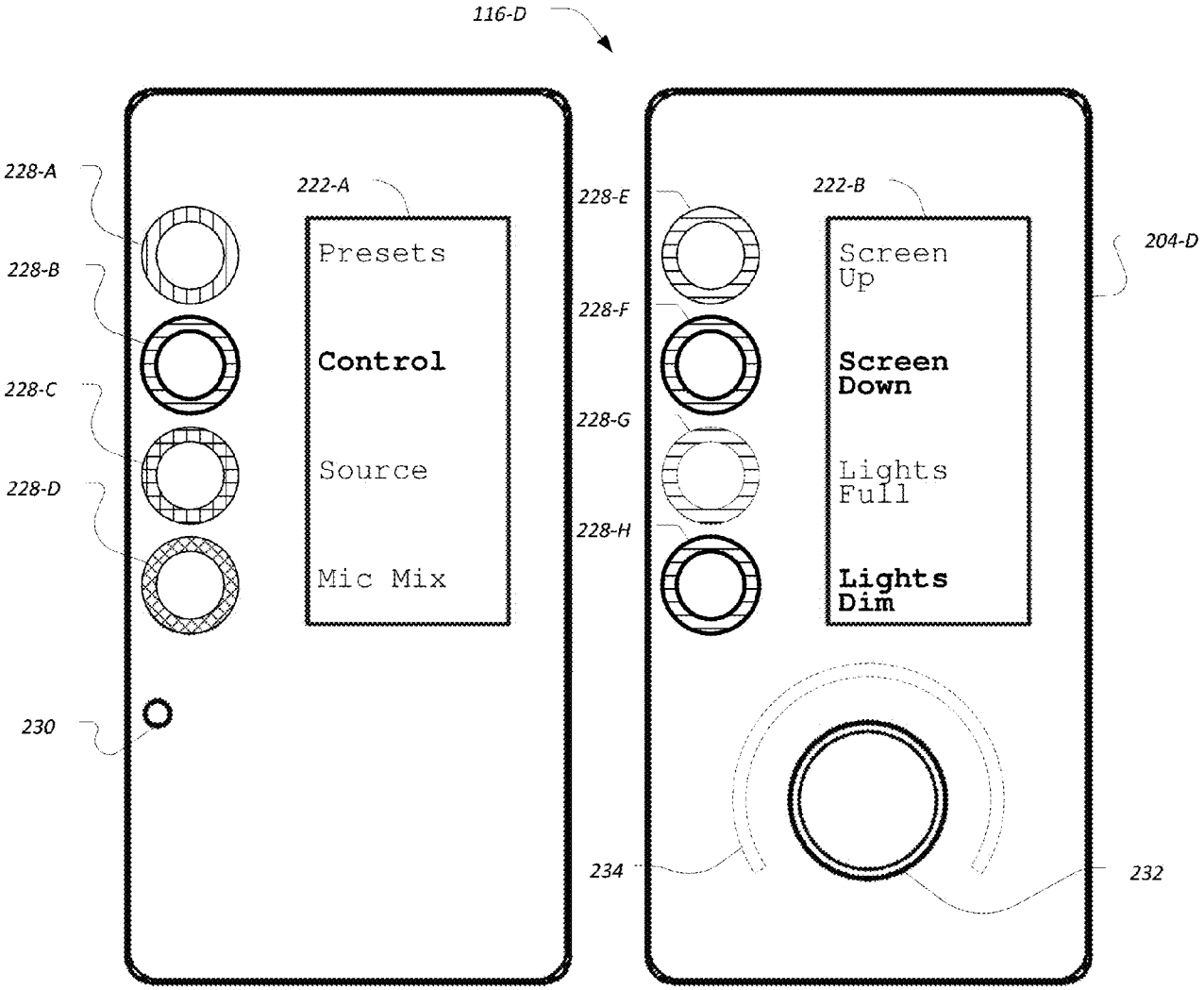
Figure 5T:
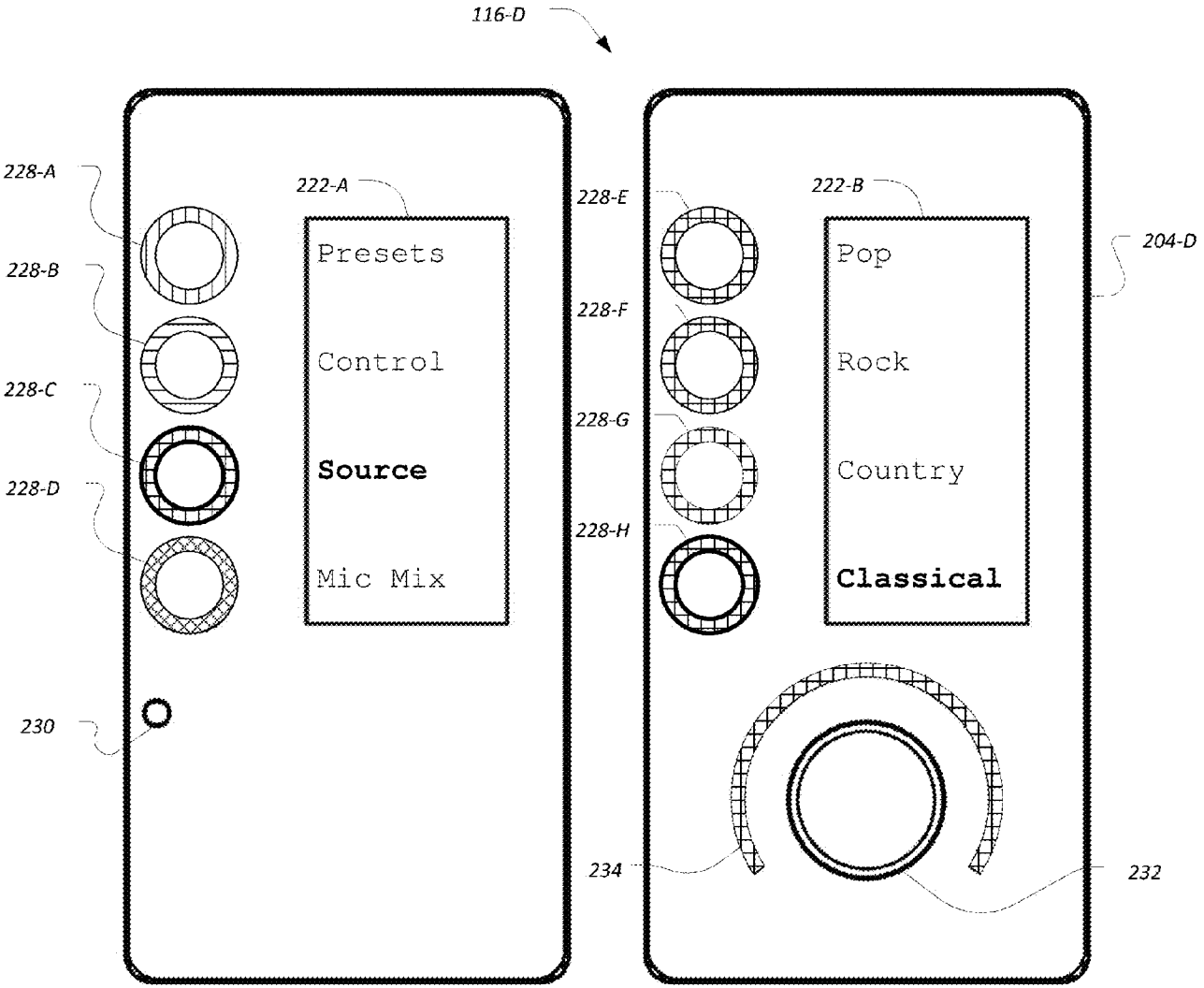
Figure 5U:
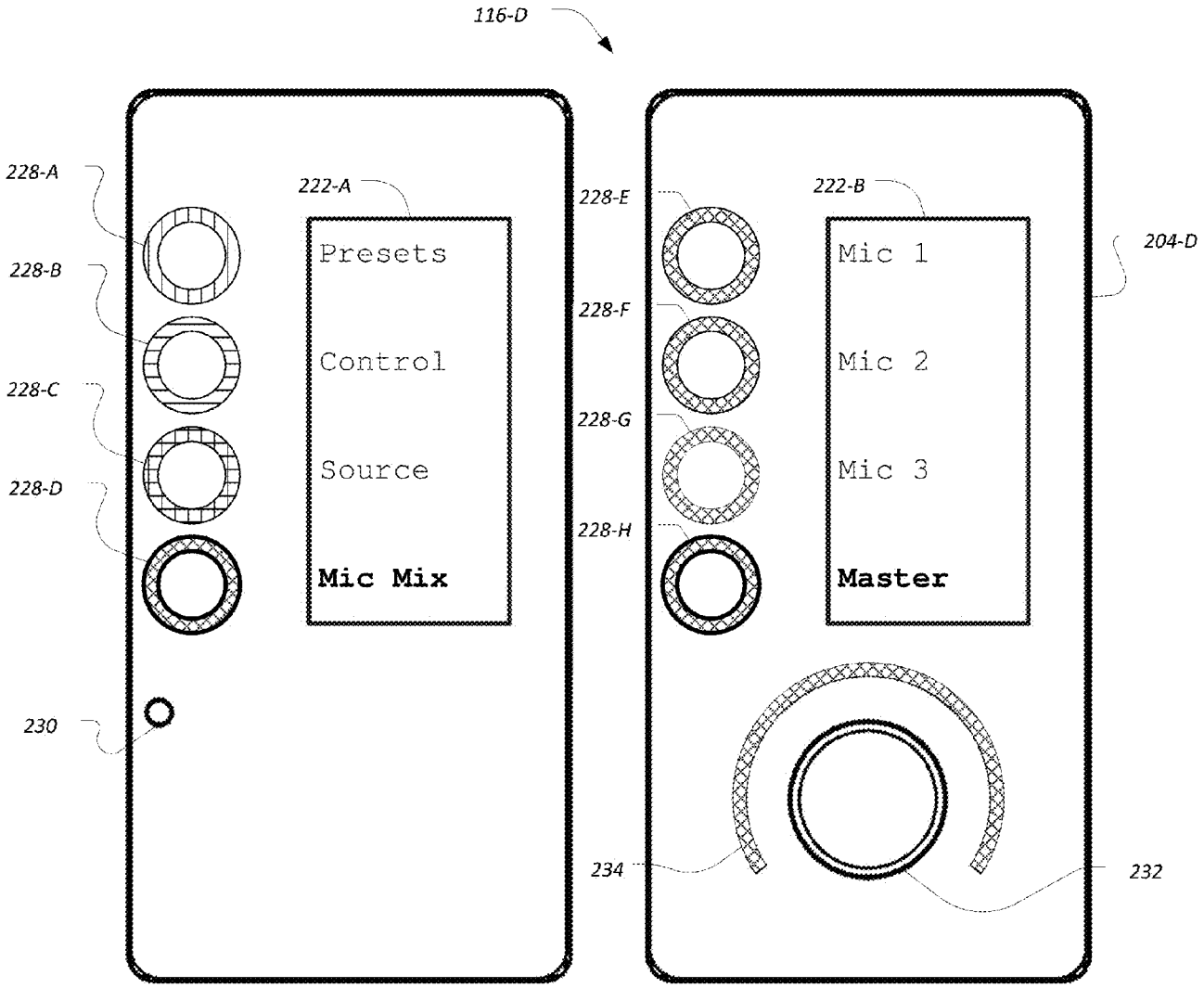

FIGS. 5A-5U each illustrates aspects of example controllers 116 to further demonstrate features of the controllers 116-A through 116-D as configured using the configuration information 118. As mentioned above, the display backlight 226 and encoder light control 234 of the controller 116 may be configured to provide for backlighting in various configurable colors. In the FIG. 5, these different backlight colors are illustrated as different patterns (e.g., blue as horizontal lines, green as downward sloping lines, yellow as square pattern, orange and diagonal lines, red or pink as vertical lines, etc.). It should be noted that the configurable sections of the display screen 222 may further be backlit in colors that correspond to the backlighting colors of the assignable buttons 228. It should also be noted that the specific color assignments to zones 112, presets, or values are merely examples, and different color assignments may be used. Further, in many cases the controller 116 may utilize intensity of the backlighting of the assignable buttons 228 to signify which assignable buttons 228 are in a selected state, and which are in a state of being available for selection. For sake of illustration, selected items in the FIG. 5 are illustrated in boldface in the screen positions 252 of the display screen 222 and with stronger outlining of the assignable buttons 228 as compared to unselected ones of the assignable buttons 228.

FIGS. 5A and 5B each illustrate an example controller 116-A having an encoder 232 for adjusting a continuous parameter. The example controller 116-A illustrated in FIG. 5A has a textual volume indication 304, while the example controller 116-A illustrated in FIG. 5B has a graphical volume indication 304. Moreover, each of the example controllers 116-A of FIGS. 5A and 5B is illustrated with the encoder light control 234 being backlit in a color configured for backlighting of the respective controllers 116-A (e.g., yellow in the illustrated example).

FIG. 5C illustrates an example controller 116-B having four assignable buttons 228 and operating to provide a source selection mode for a zone 112. For instance, the assignable button 228-A is set to select the "Pop" source, the assignable button 228-B is set to select the "Rock" source, the assignable button 228-C is set to select the "Country" source, and the assignable button 228-D is set to select the "Classical" source. Moreover, the "Country" source is currently selected. As the sources are each for playback within a single zone 112, each of the sources may be backlit in the color associated with that single zone 112 (e.g., yellow in the illustrated example).

FIG. 5D illustrates an example controller 116-C having four assignable buttons 228 and an encoder 232 and operating in a single-zone mode. Similar to the example controller 116-B illustrated in FIG. 3C, the example controller 116-C of FIG. 5D is also configured to provide for a source selection for a zone 112. As the sources are each for playback within the zone 112, each of the sources may be backlit in the same color (e.g., again yellow in the illustrated example). Moreover, as the example controller 116-C of FIG. 5D additionally includes an encoder 232, the encoder 232 may be able to provide for selection of a continuous parameter associated with the current selection. For instance, the encoder 232 may be configured in the illustrated example to allow for configuration of a continuous parameter associated with the zone 112, such as the volume being played back in the zone 112. The encoder light control 234 may also be backlit in the same color associated with the zone 112 (e.g., also yellow in the illustrated example).

FIGS. 5E-5H illustrate example controllers 116-C having four assignable buttons 228 and an encoder 232 and operating in a four-zone mode. In the four-zone mode, the controller 116-C may provide for selection among a set of zones 112 using the assignable buttons 228, and for configuration of a continuous parameter associated with the selected zone 112 using the encoder 232. As the assignable buttons 228 each indicates a different zone 112, each of the assignable buttons 228 may be backlit in a different zone-specific color. As one possibility, the "Lobby" assignable button 228-A may be backlit as purple, the "Dining" assignable button 228-B may be backlit as blue, the "Bar" assignable button 228-C may be backlit as yellow, and the "Pool and Spa" assignable button 228-D may be backlit as orange.

Moreover, the encoder light control 234 may also be backlit in the color associated with the zone 112 selected using the assignable buttons 228. For example, as shown in FIG. 5E, the "Lobby" assignable button 228-A is selected, and the encoder light control 234 is backlit in purple to correspond to the color of the selected "Lobby" zone 112. As shown in FIG. 5F, the "Dining" assignable button 228-B is selected, and the encoder light control 234 is backlit in blue to correspond to the color of the selected "Dining" zone 112. As shown in FIG. 5G, the "Bar" assignable button 228-C is selected, and the encoder light control 234 is backlit in yellow to correspond to the color of the selected "Bar" zone 112. As shown in FIG. 5H, the "Pool and Spa" assignable button 228-D is selected, and the encoder light control 234 is backlit in orange to correspond to the color of the selected "Pool and Spa" zone 112.

FIG. 5I illustrate an example controller 116-C having four assignable buttons 228 and an encoder 232 and operating in an alternate four-zone mode to facilitate configuration of a mix for the zone 112. The controller 116-C of FIG. 5I may be useful, for example, for setting the mix levels of multiple mics providing output within the zone 112. As the assignable buttons 228 each indicates a different aspect of the same zone 112, each of the assignable buttons 228 may be backlit in consistent zone-specific color.

For instance, the assignable button 228-A is set to select the "Mic 1" source, the assignable button 228-B is set to select the "Mic 2" source, the assignable button 228-C is set to select the "Mic 3" source, and the assignable button 228-D is set to select the "Mic 4" source. The encoder 232 may accordingly be configured allow for configuration of a continuous parameter associated with the currently-selected source, such as the amount of mix of the currently selected source being played in the zone 112. The encoder light control 234 may also be backlit in the same color associated with the zone 112 (e.g., blue in the illustrated example).

As shown, the assignable button 228-B for the "Mic 2" source is currently selected, and the encoder 232 may be used to adjust the amount of mix of the "Mic 2" source within the zone 112. If the user wishes to instead adjust the amount of mix of the "Mic 3" source for example, the user may select the assignable button 228-C and then utilize the encoder 232 to make the adjustment to the "Mic 3" source mix level.

FIG. 5J illustrate an example controller 116-C displaying graphical information in the display screen 222. As shown, the assignable button 228-A is associated with a microphone graphic, the assignable button 228-B is associated with a mixer graphic, the assignable button 228-B is associated with a headphone graphic, and the assignable button 228-D is associated with a mixer graphic. Thus, FIG. 5J provides an example of a controller 116-C utilizing graphical descriptions rather than textual descriptions of the associated assignable button 228.

FIG. 5K illustrates an example controller 116-D having eight assignable buttons 228 and an encoder 232 and operating in a single-zone mode. Similar to the example controller 116-C illustrated in FIG. 3D, the example controller 116-D of FIG. 5K is also configured to provide for a source selection for a zone 112. However, the controller 116-D of FIG. 5K includes eight assignable buttons 228 as compared to the four assignable buttons 228 of the controller 116-C. As the sources are each for playback within the zone 112, each of the sources may be backlit in the same color (e.g., yellow in the illustrated example). Moreover, the encoder 232 may be able to provide for selection of a continuous parameter associated with the current selection. For instance, the encoder 232 may be configured in the illustrated example to allow for configuration of a continuous parameter associated with the zone 112, such as the volume of the "Acoustic" source being played in the zone 112. The encoder light control 234 may also be backlit in the same color associated with the zone 112 (e.g., yellow in the illustrated example).

FIGS. 5L-5M illustrate example controllers 116-D having eight assignable buttons 228 and an encoder 232 and operating in a four-zone mode. As shown, the assignable buttons 228-A through 228-D may be used to select a zone 112, and the assignable buttons 228-E through 228-H may be used to select a source for playback within selected zone 112. The encoder 232 may further be used to select a volume for the selected source in the selected zone 112. Such a mode may be useful, for example, for performing source selection and volume control for four zones 112 using a single controller 116-D.

Each of the assignable buttons 228-A through 228-D may be backlit in a color associated with the respective zone 112. In an example, the "Lobby" assignable button 228-A may be backlit as purple, the "Dining" assignable button 228-B may be backlit as blue, the "Bar" assignable button 228-C may be backlit as yellow, and the "Pool and Spa" assignable button 228-D may be backlit as orange. Moreover, each of the assignable buttons 228-E through 228-H and the encoder 232 may be backlist in a color corresponding to the selected zone 112.

For instance, in FIG. 5L assignable button 228-C is selected to select the "Bar" zone 112, and the assignable buttons 228-E through 228-H and the encoder 232 are backlit in the same color as the backlighting of the assignable button 228-C (e.g., yellow). Additionally, the assignable button 228-E is selected to select the "Pop" source to be played back in the "Bar" zone 112. Similarly, in FIG. 5M assignable button 228-B is selected to select the "Dining" zone 112, and the assignable buttons 228-E through 228-H and the encoder 232 are backlit in the same color as the backlighting of the assignable button 228-B (e.g., blue). Additionally, the assignable button 228-H is selected to select the "Classical" source to be played back in the "Dining" zone 112.

FIGS. 5N-5O illustrate example controllers 116-D having eight assignable buttons 228 and an encoder 232 and operating in an eight-zone mode. As shown, the assignable buttons 228-A through 228-H may be used to select a zone 112, and the encoder 232 may be used to select a volume for the selected zone 112. Such a mode may be useful, for example, for performing volume control across a large number of zones 112 using a single controller 116-D.

Each of the assignable buttons 228-A through 228-H may be backlit in a color associated with the respective zone 112. In an example, the "Lobby" assignable button 228-A may be backlit as purple, the "Dining" assignable button 228-B may be backlit as blue, the "Bar" assignable button 228-C may be backlit as yellow, the "Pool and Spa" assignable button 228-D may be backlit as orange, the "Entrance" assignable button 228-E may be backlit in red, the "Patio" assignable button 228-F may be backlit in green, the "Parking" assignable button 228-G may be backlit in dark blue, and the "VIP" assignable button 228-H may be backlit in white.

The encoder 232 may be backlit in the same color as the backlighting of the selected assignable button 228. For example, as shown in FIG. 5N, the "Bar" assignable button 228-C is selected, and the encoder light control 234 is backlit in yellow to correspond to the color of the selected "Bar" zone 112. As in FIG. 5O, the "VIP" assignable button 228-H is selected, and the encoder light control 234 is backlit in while to correspond to the color of the selected "VIP" zone 112.

FIGS. 5P-5Q illustrate example controllers 116-D having eight assignable buttons 228 and an encoder 232 and operating in a four-by-four-zone mode. In the four-by-four mode, each of the assignable buttons 228-A through 228-D may be used to select a zone 112, each of the assignable buttons 228-E through 228-H may be used to select a sub-zone of the selected zone 112, and the encoder 232 may be used to select a value for a continuous parameter for the selected zone 112 and sub-zone. Thus, the encoder 232 may be used to adjust a parameter from a selection one of up to sixteen continuous parameters and/or toggles using the assignable buttons 228-A through 228-H of the controller 116-D.

Each of the assignable buttons 228-A through 228-H may be backlit in a color associated with the respective zone 112. In an example, the "Room 1" assignable button 228-A may be backlit as purple, the "Room 2" assignable button 228-B may be backlit as blue, the "Room 3" assignable button 228-C may be backlit as yellow, and the "Room 4" assignable button 228-D may be backlit as orange.

Moreover, each of the assignable buttons 228-E through 228-H may be used to select a configuration aspect of the selected zone 112. For instance, the assignable button 228-E is set to select the "Mic 1" source, the assignable button 228-F is set to select the "Mic 2" source, the assignable button 228-G is set to select the "Mic 3" source, and the assignable button 228-H is set to select the "Mic 4" source. The encoder 232 may accordingly be configured allow for configuration of a continuous parameter associated with the currently-selected source and zone 112, such as the amount of mix of the currently selected source being played in the selected zone 112. As each of the assignable buttons 228-E through 228-H and the encoder 232 indicates a different aspect of the same zone 112, each may be backlist in a color corresponding to the zone 112 selected from the assignable buttons 228-A though 228-D.

As shown in FIG. 5P, the assignable button 228-B for the "Room 2" zone 112 source is selected, and the assignable button 228-H for the "Mic 4" is selected. Accordingly, the encoder 232 may be used to adjust the amount of mix of the "Mic 4" source within the "Room 2" zone 112. As shown in FIG. 5Q, the assignable button 228-C for the "Room 3" zone 112 source is selected, and the assignable button 228-F for the "Mic 2" is selected. Accordingly, the encoder 232 may be used to adjust the amount of mix of the "Mic 2" source within the "Room 3" zone 112.

FIGS. 5R-5U illustrate example controllers 116-D having eight assignable buttons 228 and an encoder 232 and operating in a hybrid mode. In the hybrid mode, each of the assignable buttons 228-A through 228-D may be individually assigned to operate either as within the four-zone mode of the controller 116-D or within the four-by-four mode of the controller 116-D, and each of the assignable buttons 228-E through 228-H and the encoder 232 may function in accordance with the mode of the selected assignable button 228-A through 228-D. Thus, a wide array of functionality may be made available to a user by way of a single controller 116-D.

Each of the assignable buttons 228-A through 228-D may be backlit in a color associated with the set of functionality being exposed. In an example, the "Presets" assignable button 228-A may be backlit as purple, the "Control" assignable button 228-B may be backlit as blue, the "Source" assignable button 228-C may be backlit as yellow, and the "Mic Mix" assignable button 228-D may be backlit as orange. Moreover, each of the assignable buttons 228-E through 228-H and the encoder 232 may be backlist in a color corresponding to the selected zone 112.

As shown in the FIG. 5R, the selected "Presets" assignable button 228-A is assigned to operate in the four-zone mode. Within the selected "Presets" set of functionality, the assignable button 228-E may be selected to set a "Dinner" preset, the assignable button 228-F may be selected to set a "Yoga" preset, the assignable button 228-G may be selected to set an "Event" preset, and the assignable button 228-H may be selected to set a "Silence" preset. As shown, the "Yoga" preset of assignable button 228-F is currently selected. Notably, as the presets are not associated with continuous parameters, the encoder light control 234 may be turned off when the "Presets" assignable button 228-A is selected so as not to provide backlighting.

As shown in the FIG. 5S, the selected "Control" assignable button 228-B is assigned to operate in the four-zone mode. Within the selected "Control" set of functionality, the assignable button 228-E may be selected to invoke a "Screen Up" preset, the assignable button 228-F may be selected to invoke a "Screen Down" preset, the assignable button 228-G may be selected to invoke a "Light Full" preset, and the assignable button 228-H may be selected to set a "Lights Dim" preset. As compared to the "Presets" functionality, the "Control" presets may include two groups of options, one for screen up/down, and a second group for lights full/dim. Accordingly, as compared to the "Presets" functionality, a first selection may be made from the assignable buttons 228-E and 228-F and a second selection may be made from the assignable buttons 228-G and 228-H. For example, as shown the "Screen Down" assignable button 228-F is selected with respect to the screen functions, and the "Lights Dim" assignable button 228-H is selected with respect to the lights functions. Similar to the "Presets", as the "Control" functions are not associated with continuous parameters, the encoder light control 234 may not be backlit when the "Control" assignable button 228-B is selected.

As shown in the FIG. 5T, and similar to the controller 116-D of FIG. 5M, the selected "Source" assignable button 228-C is assigned to operate in the four-zone mode. Within the selected "Source" set of functionality, the assignable button 228-E may be selected to set a "Pop" source, the assignable button 228-F may be selected to set a "Rock" source, the assignable button 228-G may be selected to set an "Country" source, and the assignable button 228-H may be selected to set a "Country" preset. As shown, the "Country" source of assignable button 228-H is currently selected. Moreover, similar to as discussed above with respect to the FIG. 5M, the encoder 232 may further be enabled and backlit in the appropriate zone 1212 color to facilitate selection of a volume for the selected source.

As shown in the FIG. 5U, and similar to the controller 116-D of FIGS. 5P and 5Q, the assignable button 228-D is assigned to operate in the four-by-four-zone mode. In the FIG. 5U, each of the assignable buttons 228-E through 228-H may be used to select a source to be mixed into the audio, and the encoder 232 may be used to select a value of a continuous parameter for the amount of mixing of the selected source. For instance, the assignable button 228-E is set to select the "Mic 1" source, the assignable button 228-F is set to select the "Mic 2" source, the assignable button 228-G is set to select the "Mic 3" source, and the assignable button 228-H is set to select the "Mic 4" source. The encoder 232 may accordingly be configured allow for configuration of a continuous parameter associated with the currently-selected source within zone 112, such as the amount of mix of the currently selected source (e.g., Master) being played in the selected zone 112.

Figure 6:
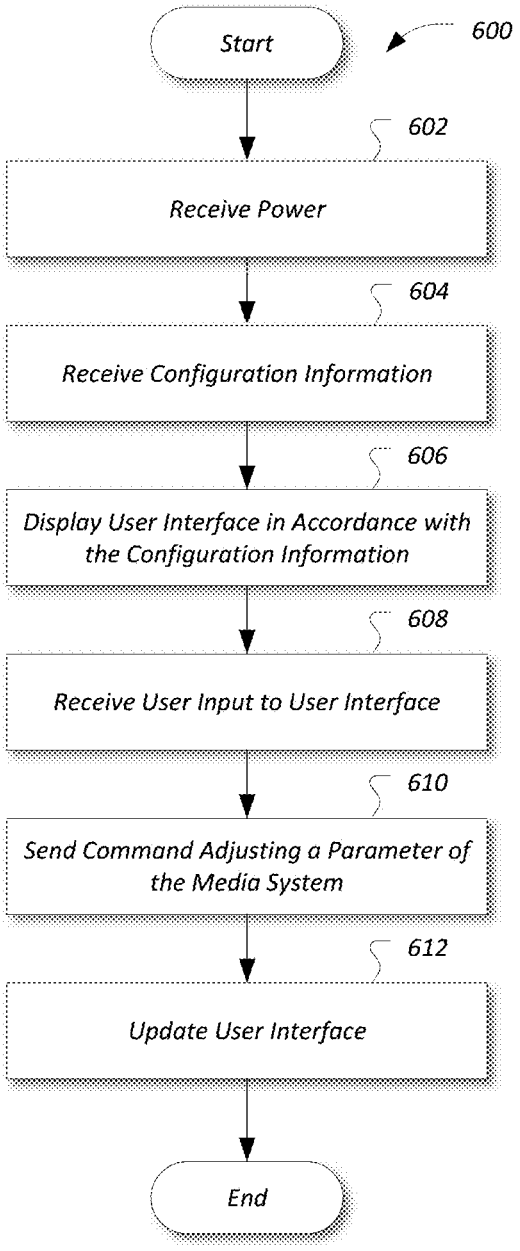
FIG. 6 illustrates an example process for using a controller to adjust one or more parameters of a media system, in accordance to one embodiment.

FIG. 6 illustrates an example process 600 for using a controller 116 to adjust one or more parameters of a media system 100. In an example, the process 600 may be performed by one or more of the controllers 116-A through 116-D discussed in detail above.

At operation 602, the controller 116 receives power. In an example, the controller 116 may be connected to the communications network 104 and may receive power over the network connection, e.g., via power-over-Ethernet (PoE) in an example. At operation 604, the controller 116 receives a controller definition. In an example, the controller 116 may receive configuration information 118 descriptive of the particular settings controllable by the controllers 116 from the control server 114.

At operation 606, the controller 116 displays a user interface for the controller 116 in accordance with the configuration information 118. The user interface may include, for example, one or more of assignable buttons 228, display screens 222, display backlights 226, and encoder light control 234. In an example, the controller 116 may set the screen positions 252 of the display screen 222 to display graphics or text descriptive of the assignable buttons 228 as indicated in the configuration information 118. The controller 116 may further backlight the assignable buttons 228 and the screen positions of the display screen 222 in accordance with the configuration information 118. Example controllers 116 in various configurations are described above with respect to the FIGS. 5A-5U.

At operation 608, the controller 116 receives user input entered to the user interface of the controller 116. In an example, the controller 116 may receive user-provided input to one or more of the assignable buttons 228 or encoders 232 of the controller 116. The controller 116 may further determine that the received input indicates an adjustment to one or more of an adjustment to a continuous parameter such as volume or mix level of a source in a zone 112, selection of a source to be played in a zone 112, selection of a preset to apply to the zone 112, or toggling of a binary parameter of the zone 112.

At operation 610, the controller 116 sends a message indicating an adjustment to a parameter of the media system 100. In an example, the controller 116 may send the command over the communications network 104 to make the adjustment to the media system 100. For instance, the command may be addressed to and configured to adjust the parameter of an amplifier 110 or other device of the media system 100.

At operation 612, the controller 116 updates the user interface. In an example, the controller 116 may adjust the selected state, backlight intensity, and/or backlight color of one or more of the assignable buttons 228, the screen positions of the display screen 222, and the encoder light control 234. After operation 612, the process 600 ends.

Computing devices described herein, such as the microcontroller 206 and programmable logic device 224 of the controller 116 and the control server 114, generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, JavaScript, C, C++, C#, Visual Basic, Java Script, Python, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A controller apparatus of a media system comprising:

a processor connected to the media system via a network connection;

at least one programmable user interface control configured to receive user input, the at least one programmable user interface control including a rotary encoder;

at least one multi-color backlight configured to backlight a respective one of the at least one programmable user interface controls in a specified color, the at least one multi-color backlight including a light ring surrounding the rotary encoder; and configuration information specifying an assignment of controllable parameters of the media system and associated backlighting color information to the at least one programmable user interface control, wherein the processor is configured to direct the multi-color backlight to backlight the at least one programmable user interface control in accordance with the backlighting color information, and to direct the light ring to display a value of a continuous parameter associated with the rotary encoder responsive to the rotary encoder being used to adjust the continuous parameter, to display a value of a binary parameter associated with the rotary encoder responsive to the rotary encoder being pushed, and to display a bouncing meter responsive to the rotary encoder not being used to adjust the continuous or binary parameters.

2. The controller apparatus of claim 1, wherein the processor is configured to receive the configuration information over the network connection.

3. The controller apparatus of claim 1, wherein the network connection is a powered network connection, and the controller apparatus is powered over the network connection.

4. The controller apparatus of claim 1, wherein the controllable parameters include one or more of a source selection, a sound level selection, a preset selection, and an output meter selection.

5. The controller apparatus of claim 1, wherein the at least one multi-color backlight provides backlighting in a selectable one of: red, green, blue, cyan, magenta, yellow, and white.

6. The controller apparatus of claim 1, wherein the at least one programmable user interface control includes a display screen and a plurality of assignable buttons, such that each assignable buttons is associated with a screen position of the display screen configured to display graphics or text descriptive of the respective assignable button, and the graphics or text are specified by the configuration information.

7. The controller apparatus of claim 1, wherein the processor is further configured to direct the multi-color backlight to backlight user interface controls that are available for selection at a first intensity level, and to backlight selected user interface controls that at a second intensity level greater than the first intensity level.

8. A controller apparatus for a media system comprising:

a user interface including:

a display screen;

assignable buttons each configured to be backlit in a controllable color and intensity and associated with respective screen position of the display screen configured to display information descriptive of the respective assignable button;

a display backlight configured to backlight each of the respective screen positions in a controllable color and intensity;

an encoder; and an encoder light control configured to backlight the encoder in a controllable color and intensity; and a processor configured to:

receive configuration information specifying an assignment of controllable parameters of the media system, control descriptions, and associated backlighting colors to the at least one programmable user interface control;

control the display screen to display the information descriptive of the assignable buttons in accordance with the control descriptions; and control the backlighting of the assignable buttons, display backlight, and encoder light control in accordance with the associated backlighting colors, such that the encoder light control displays a value of a continuous parameter associated with the encoder responsive to the encoder being used to adjust the continuous parameter, the encoder light control displays a value of a binary parameter associated with the encoder responsive to the encoder being pushed, and the encoder light control displays a bouncing meter responsive to the encoder is not being used to adjust the continuous or binary parameters.

9. The controller apparatus of claim 8, wherein the processor is further configured to:

backlight a first of the assignable buttons in a first color specified by configuration information and backlight a second of the assignable buttons in a second color specified by configuration information; and direct the encoder light control to be backlit in the first color responsive to input indicative of user selection of the first of the assignable buttons.

10. The controller apparatus of claim 9, wherein each of the assignable buttons is associated with a different one of a plurality of zones of the media system, and the processor is further configured to configure the encoder to adjust a parameter associated with the one of a plurality of zones associated with the first of the assignable buttons.

11. The controller apparatus of claim 9, wherein the processor is further configured to direct the encoder light control to be backlit in the second color responsive to input indicative of user selection of the second of the assignable buttons.

12. The controller apparatus of claim 8, wherein the configuration information specifies a first subset of the assignable buttons each associated with a different one of a plurality of zones of the media system, and a second subset of the assignable buttons each associated with a source, wherein the processor is further configured to configure the encoder to adjust a parameter associated with a zone selected using the first subset of the assignable buttons and a parameter selected using the second subset of the assignable buttons.

13. A method for controlling a media system comprising:

receiving, over a network by a media system controller, configuration information specifying an assignment of controllable parameters of the media system to programmable user interface controls of the media system controller, the programmable user interface controls including a rotary encoder and a light ring surrounding the rotary encoder;

displaying information descriptive of the controllable parameters specified by the configuration information in a display screen of the media system controller;

backlighting the programmable user interface controls according to color information specified by configuration information;

displaying a value of a continuous parameter associated with the rotary encoder on the light ring responsive to the rotary encoder being used to adjust the continuous parameter;

displaying a value of a binary parameter associated with the rotary encoder responsive to the rotary encoder being pushed; and displaying a bouncing meter on the light ring associated with the rotary encoder responsive to the rotary encoder not being used to adjust the continuous or binary parameters.

14. The method of claim 13, wherein the user interface controls include assignable buttons and an encoder, and further comprising:

backlighting a first of the assignable buttons in a first color specified by configuration information and backlight a second of the assignable buttons in a second color specified by configuration information; and directing a light control of the encoder to be backlit in the first color responsive to input indicative of user selection of the first of the assignable buttons.

15. The method of claim 14, wherein each of the assignable buttons is associated with a different one of a plurality of zones of the media system, and further comprising configuring the encoder to adjust a parameter associated with the one of a plurality of zones associated with the first of the assignable buttons.

16. The method of claim 14, further comprising directing the light control of the encoder to be backlit in the second color responsive to input indicative of user selection of the second of the assignable buttons.

17. The method of claim 13, further comprising:

backlighting user interface controls that are available for selection at a first intensity level; and backlighting selected user interface controls that at a second intensity level greater than the first intensity level.

* * * * *